US008686646B2

(12) United States Patent
Tanaka et al.

(10) Patent No.: US 8,686,646 B2
(45) Date of Patent: Apr. 1, 2014

(54) ILLUMINATING DEVICE

(75) Inventors: Masahide Tanaka, Osaka (JP); Mitsunori Nagashima, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 118 days.

(21) Appl. No.: 13/322,236

(22) PCT Filed: Apr. 26, 2010

(86) PCT No.: PCT/JP2010/057361

§ 371 (c)(1),
(2), (4) Date: Nov. 23, 2011

(87) PCT Pub. No.: WO2010/137436

PCT Pub. Date: Dec. 2, 2010

(65) Prior Publication Data

US 2012/0074850 A1 Mar. 29, 2012

(30) Foreign Application Priority Data

May 27, 2009 (JP) ..... 2009-127206
Jun. 22, 2009 (JP) ..... 2009-147167

(51) Int. Cl.
*H05B 37/02* (2006.01)

(52) U.S. Cl.
USPC ..... 315/152

(58) Field of Classification Search
None
See application file for complete search history.

(56) References Cited

U.S. PATENT DOCUMENTS 6,137,237 A * 10/2000 MacLennan et al. ..... 315/248
6,313,587 B1 * 11/2001 MacLennan et al. ..... 315/248
6,949,887 B2 * 9/2005 Kirkpatrick et al. ..... 315/248
8,098,015 B2 * 1/2012 Kotani et al. ..... 315/88
2004/0232856 A1 11/2004 Huber
2006/0092018 A1 * 5/2006 Jaffar et al. ..... 340/540
2007/0236154 A1 * 10/2007 Lee ..... 315/246
2010/0283391 A1 * 11/2010 Braunshtein ..... 315/127
2010/0328943 A1 12/2010 Takamura et al.

FOREIGN PATENT DOCUMENTS

CN 1756452 4/2006
CN 1770941 5/2006
JP H09-289088 11/1997
JP 2000-228290 8/2000
JP 2002-246187 8/2002
JP 2004-006227 1/2004
JP 2004-335426 11/2004
JP 2004-349257 12/2004
JP 2005-19000 1/2005
JP 2006-156367 6/2006

(Continued)

OTHER PUBLICATIONS

Page from Official Communication issued by the State Intellectual Property Office of People's Republic of China in Patent Application No. 201080022417.8, mailed on Aug. 28, 2013.

*Primary Examiner* — Crystal L Hammond
(74) *Attorney, Agent, or Firm* — Fish & Richardson P.C.

(57) ABSTRACT

Disclosed is an illuminating device which has: a first illuminating lamp which is disposed at a first predetermined position and is identifiable; a second illuminating lamp which is disposed at a second predetermined position having a predetermined relationship with the first predetermined position and is identifiable; a determining means which determines the mutual relationship between the first illuminating lamp and the second illuminating lamp; and a transmitting means which transmits identifiable control signals to the first illuminating lamp and the second illuminating lamp, respectively, so as to achieve the determination made by the determining means.

20 Claims, 20 Drawing Sheets

(56) References Cited

FOREIGN PATENT DOCUMENTS

| | | |
|---|---|---|
| JP | 2007-214053 | 8/2007 |
| JP | 2007-280957 | 10/2007 |
| JP | 2008-034989 | 2/2008 |
| JP | 2008-058367 | 3/2008 |
| JP | 2008-282743 | 11/2008 |
| JP | 2009-87830 | 4/2009 |
| JP | 2009-117080 | 5/2009 |

* cited by examiner

ILLUMINATING DEVICE

TECHNICAL FIELD

The present invention relates to illuminating devices.

BACKGROUND ART

For ceiling illumination and wall surface illumination, fluorescent lamps in the shape of long tubes are typically used. To make the seams between segments of linear illumination invisible, for example in indirect illumination and the like, long-tube-shaped fluorescent lamps are often arranged with their adjacent ends overlapping with one another inside a recess the inside of which is not directly visible. Proposals have also been made to improve the design of long-tube-shaped fluorescent lamps themselves to enable them to emit light even at their ends so that no seems may be visible when they are arranged linearly (Patent Document 1). On the other hand, with ever increasing use of LEDs in recent years, proposals have also been made to design white LEDs to be compatible with fluorescent lamps for use in common ceiling illumination (Patent Document 2).

LIST OF CITATIONS

Patent Literature

Patent Document 1: JP-A-2008-282743
Patent Document 2: JP-A-2004-335426

SUMMARY OF INVENTION

Technical Problem

To cope with a variety of needs at actual illumination sites, however, a number of problems still need to be addressed.

In view of the above problems encountered by the present inventors, it is an object of the present invention to provide an illuminating device that makes it possible to control a plurality of illuminating lamps in a mutually associated manner and that can effectively acquire information needed for illuminating lamps.

Solution to Problem

To achieve the above object, according to the present invention, an illuminating device is provided with: a first illuminating lamp which is arranged at a first predetermined position and which is identifiable; a second illuminating lamp which is arranged at a second predetermined position having a predetermined relationship with the first predetermined position and which is identifiable; determining means for determining an interrelationship between the first and second illuminating lamps; and transmitting means for transmitting identifiable control signals to the first and second illuminating lamps respectively to enable determination by the determining means (a first configuration).

In the illuminating device of the first configuration described above, preferably, the first and second illuminating lamps each include a plurality of LEDs (a second configuration).

In the illuminating device of the first configuration described above, preferably, the first and second illuminating lamps are arranged so as to appear to emit light with no seam therebetween (a third configuration).

In the illuminating device of the third configuration described above, preferably, the determining means determines the interrelationship such that the lighting condition changes at a midway point within at least one of the first and second illuminating lamps and that a common lighting condition is applied in parts of the first and second illuminating lamps which joint the first and second illuminating lamps (a fourth configuration).

In the illuminating device of the fourth configuration described above, preferably, the determining means can alter the point at which lighting condition changes (a fifth configuration).

In the illuminating device of the first configuration described above, preferably, identification information storing means is provided at each of the first and second predetermined positions, and when the first and second illuminating lamps are arranged at the first and second predetermined positions, the first and second illuminating lamps acquire identification information from the identification information storing means (a sixth configuration).

According to the present invention, an illuminating device is provided with: information storing means provided at a predetermined position where an illuminating lamp is arranged; and an illuminating lamp which, when arranged at the predetermined position, acquires stored information from the information storing means (a seventh configuration).

In the illuminating device of the seventh configuration described above, preferably, the information is information necessary to control the illuminating lamp (an eighth configuration).

In the illuminating device of the seventh configuration described above, preferably, the stored information is stored from the illuminating lamp to the information storing means, and when the illuminating lamp is replaced, the new illuminating lamp acquires the stored information from the information storing means (a ninth configuration).

In the illuminating device of the seventh configuration described above, preferably, the illuminating lamp is provided with: a first LED group; a second LED group which is arranged in a different region from the first LED group; a first control section which controls lighting of the first LED group; a second control section which controls lighting of the second LED group; and a signal input section which inputs, from outside to the first and second control section, a signal for controlling the first and second LED groups independently (a tenth configuration).

In the illuminating device of the tenth configuration described above, preferably, the first LED group has a plurality of LEDs arranged in a row, and the second LED group has a plurality of LEDs arranged in a row on an extension line of the row of the first LED group (an eleventh configuration).

In the illuminating device of the tenth configuration described above, preferably, there are further provided: a first power supply section which energizes the first LED group and the first control section; and a second power supply section which energizes the second LED group and the second control section (a twelfth configuration).

In the illuminating device of the tenth configuration described above, preferably, there are further provided: a first circuit board on which the first LED group and the first control section are mounted; and a second circuit board on which the second LED group and the second control section are mounted (a thirteenth configuration).

In the illuminating device of the tenth configuration described above, preferably, the first LED group has a plurality of LEDs that are serially connected, and the second LED group has a plurality of LEDs that are serially connected separately from the first LED group (a fourteenth configuration).

According to the present invention, an illuminating device is provided with: a first illuminating lamp having a first light emission section forming a row and a second light emission section forming a row and arranged on an extension line of the row of the first light emission section; a second illuminating lamp having a third light emission section forming a row and arranged on an extension line of the row of the second light emission section and a fourth light emission section forming a row and arranged on an extension line of the row of the third light emission section; and a commanding section which performs control such that the first and second light emission sections are lit in different lighting conditions and the second and third light emission sections are lit in the same lighting condition (a fifteenth configuration).

In the illuminating device of the fifteenth configuration described above, preferably, there are further provided: a plurality of photometry sections which are arranged at different positions; and a commanding section which instructs the control section to perform control based on a result of photometry by the plurality of photometry sections (a sixteenth configuration).

In the illuminating device of the fifteenth configuration described above, preferably, there are further provided: determining means for determining a target position; and a commanding section which instructs the control section to perform control such as to apply an illumination condition with the target position set at a center (a seventeenth configuration) .

In the illuminating device of the seventeenth configuration described above, preferably, the commanding section instructs the control section to reduce the amount of light emitted by any of the light emission sections which is responsible for illumination of an area far from the target position set at the center (an eighteenth configuration).

In the illuminating device of the sixteenth configuration described above, preferably, the plurality of photometry sections are arranged close to the plurality of light emission sections respectively, and have correcting means for compensating for the influence of light emitted by the light emission sections themselves on the photometry sections (a nineteenth configuration).

In the illuminating device of the sixteenth configuration described above, preferably, the plurality of photometry sections are arranged at positions illuminated by the plurality of light emission sections respectively (a twentieth configuration).

Advantageous Effects of the Invention

According to the present invention, it is possible to provide an illuminating device that makes it possible to control a plurality of illuminating lamps in a mutually associated manner and that can effectively acquire information needed for illuminating lamps.

DESCRIPTION OF EMBODIMENTS

Example 1

Figure 1:
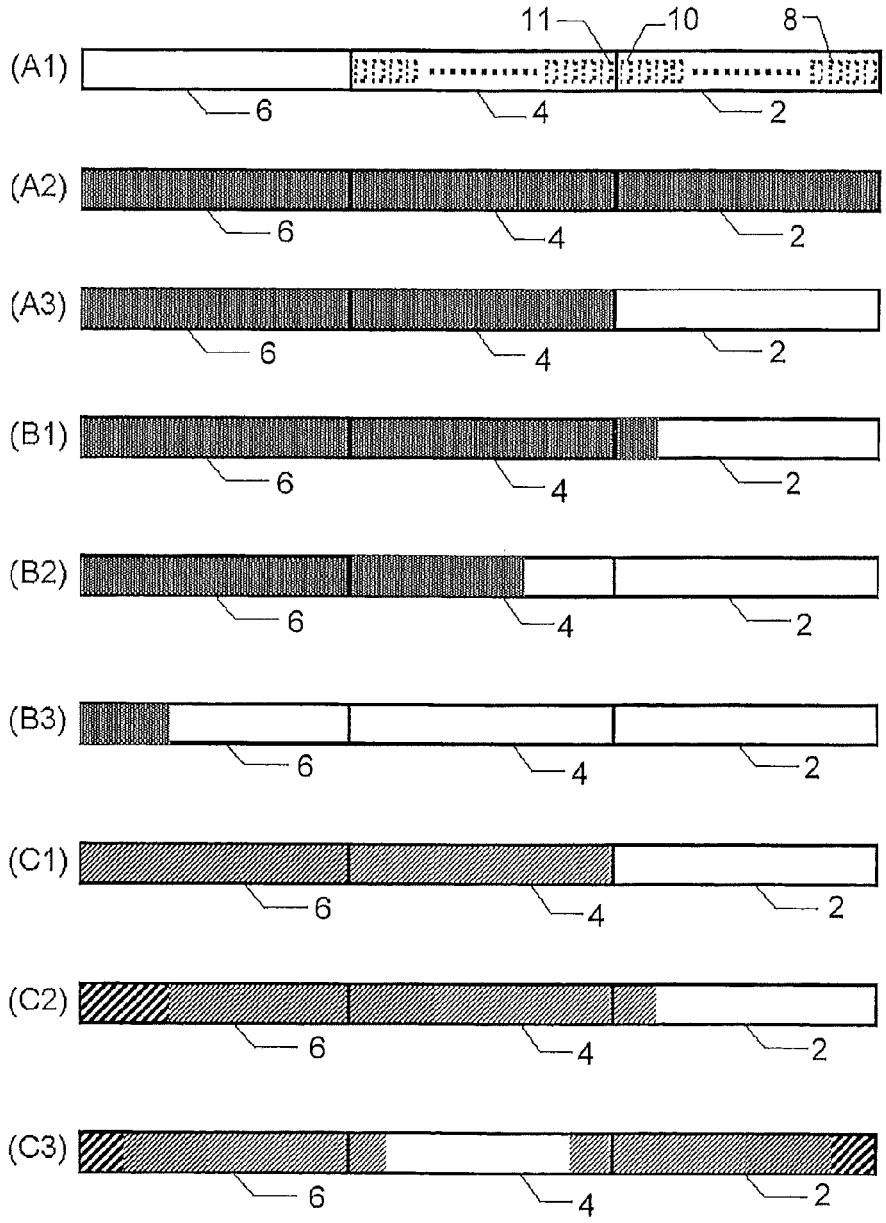
FIG. 1 comprises exterior views, in different lighting states, of an illuminating device of Example 1 of the invention (Example 1)

FIG. 1 comprises exterior views, in different lighting states, of an illuminating device of Example 1 of the invention. FIG. 1(A1) shows linear LED illuminating lamps 2, 4, and 6 arranged in a straight line and all lit. The LED illuminating lamps 2, 4, and 6 each have a large number of white LEDs 8, 10, 11, etc. arranged in a row inside them, with these covered with a transmissive-diffusive cover. It should be noted that FIG. 1(A1) schematically shows the LEDs 8, 10, 11, etc. in an exaggerated size; in reality, the LED illuminating lamps 2, 4, and 6 each have a larger number of (for example, 288) white LEDs arranged in a row inside them.

The LED illuminating lamps 2, 4, and 6 are arranged with their adjacent ends close together. Thus, for example, the white LED 10 at the left end, as seen in the figure, of the LED illuminating lamp 2 emits light at a position close to the white LED 11 at the right end of the LED illuminating lamp 4, and the transmissive-diffusive covers covering those white LEDs respectively make them individually indistinguishable. Consequently, the LED illuminating lamps 2, 4, and 6 emit light as if they were a seamless, continuous, single LED illuminating lamp.

FIG. 1(A2) shows the LED illuminating lamps 2, 4, and 6 all extinguished. Thus, the simplest lighting states in Example 1 are those shown in FIGS. 1(A1) and 1(A2), between which the LED illuminating lamps 2, 4, and 6 are all lit or extinguished simultaneously as if they were a single LED illuminating lamp as a whole. In Example 1, it is also possible to control the lighting of the LED illuminating lamps individually. Fig. (A3) shows an example where, while the LED illuminating lamp 2 is extinguished, the LED illuminating lamps 4 and 6 are extinguished. Lighting like that shown in Fig. (A3) is suitable, for example, as illumination at a lecture hall where a projection screen for a projector is placed on the LED illuminating lamp 6 side, audience seats are placed on the LED illuminating lamp 2 side, and the audience needs illumination to take notes.

Moreover, in Example 1 of the invention, the lighting of the white LEDs within each of the LED illuminating lamps 2, 4, and 6 can be controlled independently for each of six divisions into which the white LEDs are divided. The details will be given later. In Example 1, since the LED illuminating lamps 2, 4, and 6 emit light as if they were a seamless, single LED illuminating lamp as described above, when part of them is lit, the borderline between the lit and extinguished parts does not necessarily have to be located at a boundary between LED illuminating lamps as shown in FIG. 1(A3), but may be at a midway point within an LED illuminating lamp. FIGS. 1(B1) to 1(B3) shows such examples.

For example, in FIG. 1(B1), the LED illuminating lamps 4 and 6 and one-sixth of the LED illuminating lamp 2 from left are extinguished, and the remaining five-sixths of the LED illuminating lamp 2 are lit. In FIG. 1(B2), the LED illuminating lamp 6 and four-sixths of the LED illuminating lamp 4 from left are extinguished, and the remaining two-sixths of the LED illuminating lamp 4 and the LED illuminating lamp 2 are lit. It should be noted here that the lit parts of the LED illuminating lamps 2 and 4 appear to be lit with no seam between them. In other words, the LED illuminating lamps 2, 4, and 6 function as if they are a seamless, single LED illuminating lamp, and the borderline between the lit and extinguished parts is located at a midway point within the LED illuminating lamp 4. Likewise, in FIG. 1(B3), two-sixths of the LED illuminating lamp 6 from left are extinguished, and the remaining fourth-sixths of the LED illuminating lamp 6 and the LED illuminating lamps 4 and 2 are lit. In this case, the borderline between the lit and extinguished parts is located at a midway point within the LED illuminating lamp 6.

As described above, in Example 1, by making LED illuminating lamps emit light with no seams between them, and dividing the white LEDs within each LED illuminating lamp into a plurality divisions so that their lighting can be controlled independently for each division, it is possible to flexibly control the borderline between lit and extinguished parts. This makes it possible to provide the optimum illumination that suits the conditions at a site like, for example, a lecture hall where a projection screen for a projector is placed as described above. In such control, the borderline between lit and extinguished parts may be located at a boundary between LED illuminating lamps as shown in FIG. 1(A3). That is, in that they both serve as a borderline between lit and extinguished parts, a boundary between LED illuminating lamps and a midway point within an LED illuminating lamp are equivalent. In practice, as will be described later, the location of a borderline between lit and extinguished parts can be changed easily by sliding a lever—provided in a remote control unit so as to be linearly movable—in a direction corresponding to the direction of the row from the LED illuminating lamp 2 to the LED illuminating lamp 6.

Furthermore, in Example 1 of the invention, light adjustment of brightness in a lit state is also possible by PWM (pulse-width modulation) control, and in addition the light adjustment can be done not only for each LED illuminating lamp but also independently for each of the six divisions of white LEDs within each LED illuminating lamp. Accordingly, when all the LED illuminating lamps 2, 4, and 6 are lit as in FIG. 1(A1), not only can their overall brightness be controlled, but light adjustment is also possible so as to apply gradations in the direction of the row of the LED illuminating lamps. FIGS. 1(C1) to 1(C3) show such examples.

FIG. 1(C1) shows an example where different gradations are applied to different LED illuminating lamps, with the LED illuminating lamp 2 controlled to be lit at a duty of 100%, the LED illuminating lamp 4 at a duty of 50%, and the LED illuminating lamp 6 at a duty of 25%. In other words, in this example, the borderlines between different duties are located at the boundaries between the LED illuminating lamps. FIG. 1(C2) shows an example where different gradations are applied by independently controlling the six divisions of white LEDs within each LED illuminating lamp. Specifically, the five-sixths of the LED illuminating lamp 2 from right are controlled to be lit at a duty of 100%, the remaining one-sixth of the LED illuminating lamp 2 and the four-sixths of the LED illuminating lamp 4 from right at a duty of 50%, the remaining two-sixths of the LED illuminating lamp 4 and fourth-sixths of the LED illuminating lamp 6 from right at a duty of 25%, and the remaining two-sixths of the LED illuminating lamp 6 at a duty of 13%. In other words, in this example, the borderlines between different duties are located at midway points within LED illuminating lamps. Even in this case, the boundary between LED illuminating lamps at the same duties is seamless and continuous.

FIG. 1(C3), like FIG. 1(C2), shows an example where the borderlines between different duties are located at midway points within LED illuminating lamps. Here, however, instead of duties varying in one direction, light adjustment is done such that the LED illuminating lamps 2, 4, and 6 are lit with increasingly less brightness from the center to each end. Moreover, the LED illuminating lamps 2 and 6 each have two borderlines between different duties at midway points within them.

Graded light adjustment as shown in FIGS. 1(C1) to (C3) is suitable for illumination in a room with a window during the day. In both examples shown in FIGS. 1(C1) and 1(C2), there is a window at the left side of the room, and illumination is reduced near the window where light can be taken in from outside, with the aim of making the room uniformly light and saving electric power. Roughly similar control is possible also by, as shown in FIGS. 1(A1), 1(B1), and 1(B3), completely extinguishing an LED illuminating lamp or part of it near the window. However, since complete extinction may give the room a dark impression, a capability of graded light adjustment as shown in FIGS. 1(C1) and 1(C2) not only makes a room uniformly light, but is beneficial psychologically as well. Graded light adjustment as shown in FIG. 1(C3) is suitable in a case where there is windows at both sides of the room.

Figure 2:
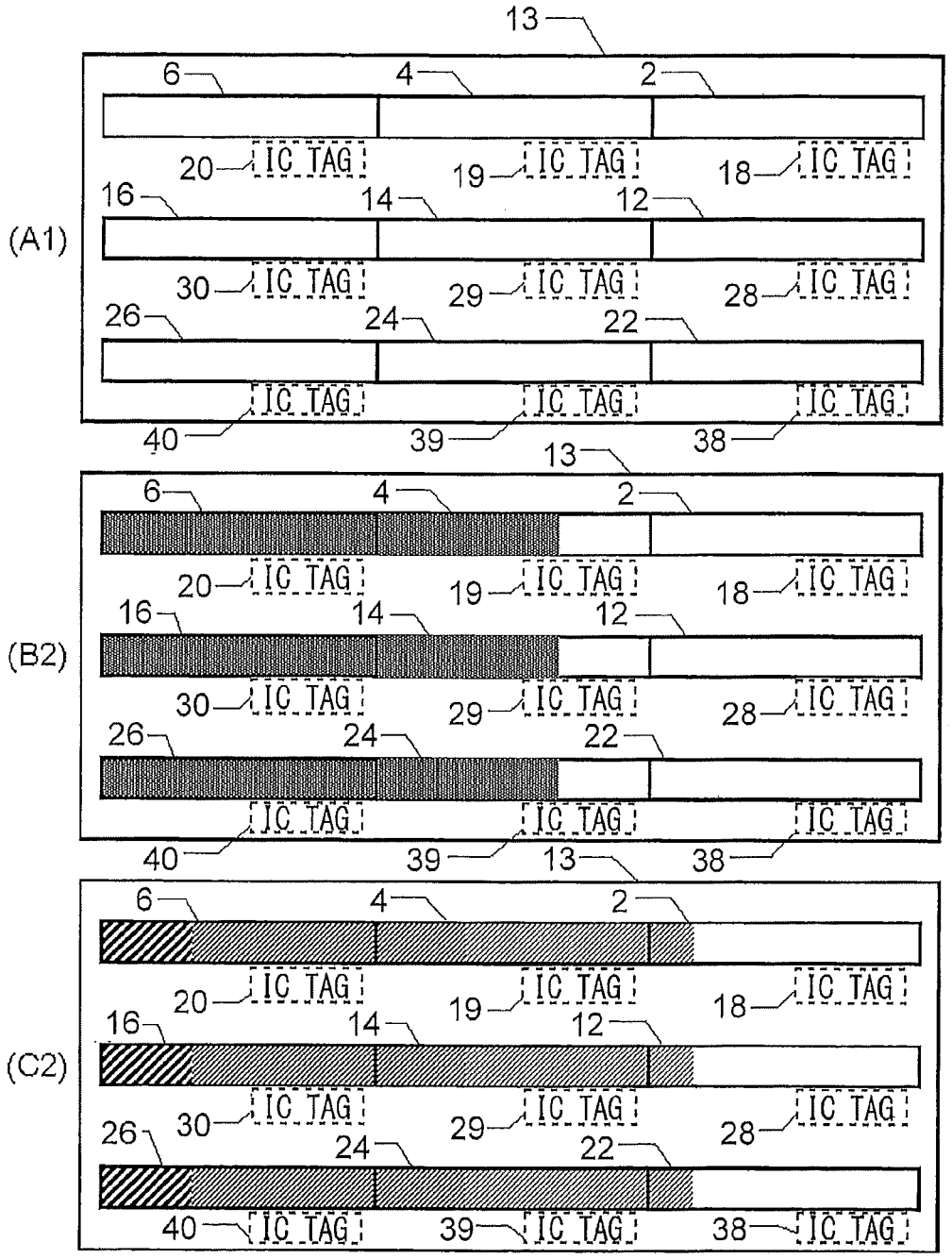
FIG. 2 comprises arrangement diagrams of the illuminating device of Example 1, as mounted on a ceiling.

FIG. 2 comprises arrangement diagrams of the illuminating device of Example 1 as mounted on a ceiling 13, as viewed from below. FIG. 2(A1) corresponds to the state shown in FIG. 1(A1) in FIG. 1, and shows a state in which all the LED illuminating lamps arranged on the ceiling 13 are lit. In FIG. 2(A1), on the ceiling 13 are mounted, in addition to a row of LED illuminating lamps 2, 4, and 6, another row of LED illuminating lamps 12, 14, and 16, and yet another row of LED illuminating lamps 22, 24, and 26, thus a total of three rows of LED illuminating lamps. The LED illuminating lamps are each mounted on the ceiling 13 with a holder, which will be described later, and are energized via a cable, which will be described later.

The holder on the ceiling 13 on which the LED illuminating lamps 2, 4, and 6 are mounted is provided with IC tags 18, 19, and 20 respectively. Likewise, for the LED illuminating lamps 12, 14, and 16, IC tags 28, 29, and 30 are provided respectively, and for the LED illuminating lamps 22, 24, and 26, IC tags 38, 39, and 40 are provided respectively. The IC tags 18, 19, 20, 28, 29, 30, 38, 39, and 40 each store two kinds of information: one is an ID unique to the IC tag, and the other is a channel for a control signal for controlling the corresponding LED illuminating lamp. For example, the IC tags 18, 28, and 38 are assigned, and thus store, channel 1; the IC tags 19, 29, and 39 are assigned, and thus store, channel 2; and the IC tags 20, 30, and 40 are assigned, and thus store, channel 3. The details of how the channels are assigned will be given later.

As will be described later, the LED illuminating lamps are each provided with an IC tag reader/writer, and when an LED illuminating lamp is mounted on a holder, channel information is read from the IC tag at the mounting position. Specifically, in a case where it is done based on the information stored in the IC tags mentioned just above, for the LED illuminating lamps 2, 12, and 22, channel 1 is read; for the LED illuminating lamps 4, 14, and 24, channel 2 is read; and for the LED illuminating lamps 6, 16, and 26, channel 3 is read. That is, for the LED illuminating lamps located in the same row in the vertical direction in FIG. 2, the same channel is read. Based on the channels of the individual LED illuminating lamps thus determined, signals for controlling their lighting states are transmitted from a remote control unit on a channel-by-channel basis as will be described later. FIG. 2(A1) shows what results when a signal demanding full lighting at a duty of 100% is transmitted across all the channels.

FIG. 2(B2) corresponds to the state shown in FIG. 1(B2) in FIG. 1, and shows a state in which a right part of each of the three rows of LED illuminating lamps 4, 14, and 24 is lit, with a borderline located at a midway point within them. To obtain this lighting state, a signal demanding full lighting at a duty of 100% is transmitted across channel 1; a signal demanding the lighting of only four-sixths from right at a duty of 100% is transmitted across channel 2, and an extinction signal is transmitted across channel 3. The transmission of these channel signals is done automatically when the desired lighting state is determined, and accordingly no manual operation is necessary to transmit them individually. As described above in connection with FIG. 1, a lighting state like that shown in Fig. (B2) is suitable, for example, as illumination at a lecture hall where a projection screen for a projector is placed at the left side of FIG. 2 and audience seats are placed at the right side.

FIG. 2(C2) corresponds to the state shown in FIG. 1(C2) in FIG. 1, and shows a state in which graded illumination is done such that the three rows of LED illuminating lamps are all increasingly dim rightward in FIG. 2. To obtain this lighting state, a lighting signal demanding the lighting of five-sixths from right at a duty of 100% and the lighting of the rest at a duty of 50% is transmitted across channel 1; a lighting signal demanding the lighting of four-sixths from right at a duty of 50% and the lighting of the rest at a duty of 25% is transmitted across channel 2; and a lighting signal demanding that lighting of four-sixths from right at a duty of 25% and the lighting of the rest at a duty of 13% is transmitted across channel 3. The transmission of these channel signals, too, is done automatically when the desired gradation state is determined, and accordingly no manual operation is necessary to transmit them individually. As described above in connection with FIG. 1, a lighting state like that shown in Fig. (C2) is suitable, for example, as illumination in a room with a window at the left side in FIG. 2.

Figure 3:
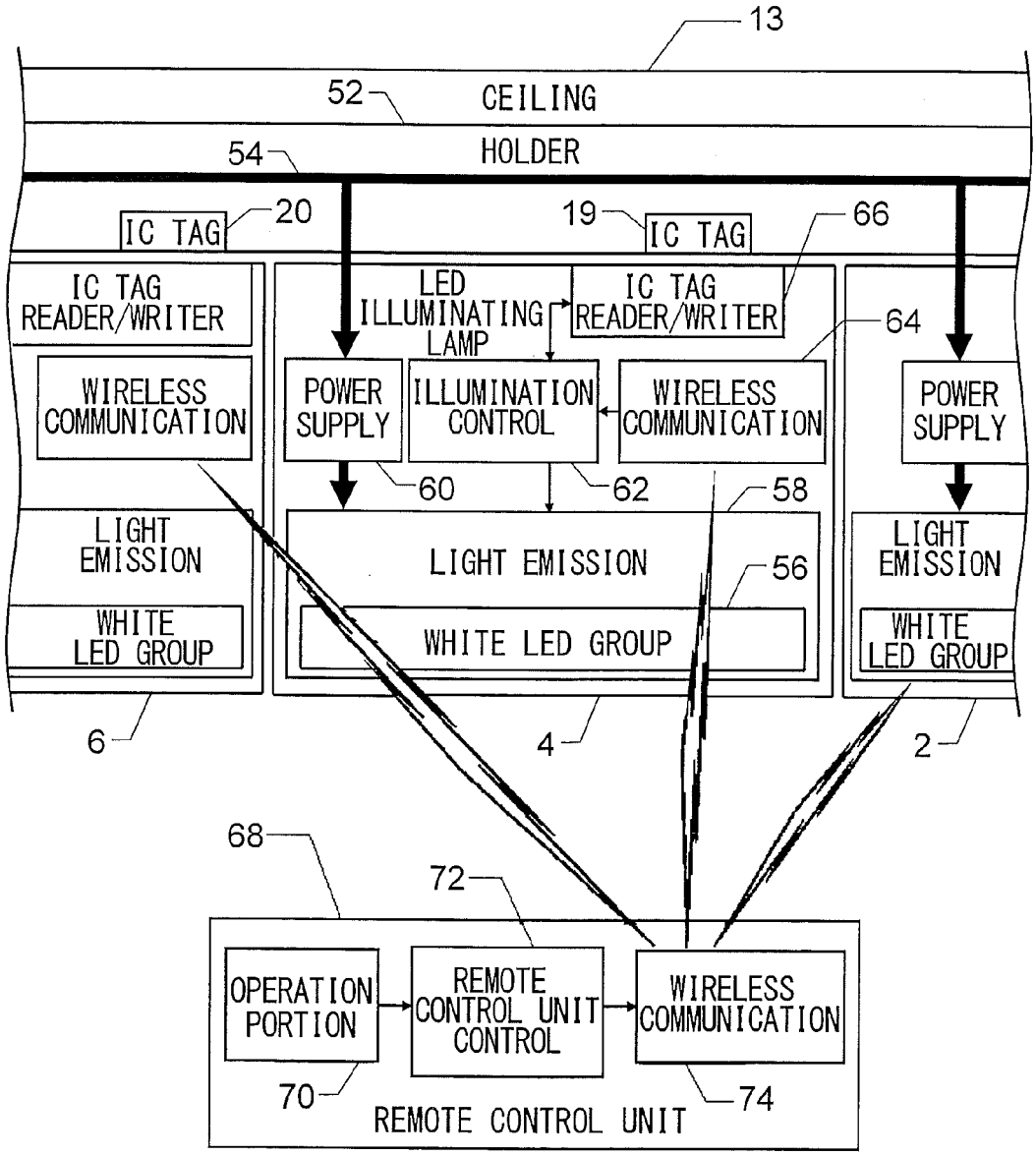
FIG. 3 is a block diagram schematically showing a section of a principal portion of Example 1.

FIG. 3 is a block diagram schematically showing a section of a principal part, around the LED illuminating lamp 4, of Example 1. The same parts as are shown in FIGS. 1 and 2 are identified by the same reference signs. The ceiling 13 is fitted with a holder 52, in which a cable 53 is laid. As described above in connection with FIG. 2, the holder 52 is provided with IC tags 19, 20, etc. at positions corresponding to where the LED illuminating lamps 4, 6, etc. are fitted.

The LED illuminating lamp 4, which is interchangeably fitted to the holder 52, has a light emission section 58 including a group of white LEDs 56, and is energized by a power supply 60, which is connected to a cable 54. The group of white LEDs 56 collectively refers to the white LEDs 11 etc. in FIG. 1. Though not illustrated, the power supply 60 also feeds necessary voltages to other parts in the LED illuminating lamp 4, such as an illumination control section 62, a wireless communication section 64, and an IC tag reader/writer 66. The illumination control section 62 controls the lighting state of the light emission section 58 according to remote control signals received by the wireless communication section 64.

The illumination control section 62 has a storage section for storing a program for controlling LED illuminating lamps along with necessary data. The remote control signals received by the wireless communication section 64 are those for infrared rays communication or a WPAN (wireless personal area network) such as Zigbee (a trademark). The IC tag reader/writer 66 communicates with the IC tag 19 when the LED illuminating lamp 4 is fitted to the holder 52, to read and store the ID unique to the IC tag along with, if any, a channel stored there. When no channel is stored in the IC tag 19, one is written to it from the IC tag reader/writer 66. The details of these functions will be given later.

A remote control unit 68 has an operation section 70 from which to operate the individual LED illuminating lamps. A remote control unit control section 72 instructs a wireless communication section 74 to transmit remote control signals based on manual operation on the operation section 70. The remote control unit control section 72 has a storage section for storing a program for controlling the remote control unit along with necessary data. The wireless communication section 64 of each LED illuminating lamp receives remote control signals from the remote control unit 68 and delivers them to the illumination control section 62. The other LED illuminating lamps 2, 6, etc. have a configuration similar to that of the LED illuminating lamp 4 described above; they are energized via the cable 54 and are controlled according to remote control signals from the remote control unit 68.

Figure 4:
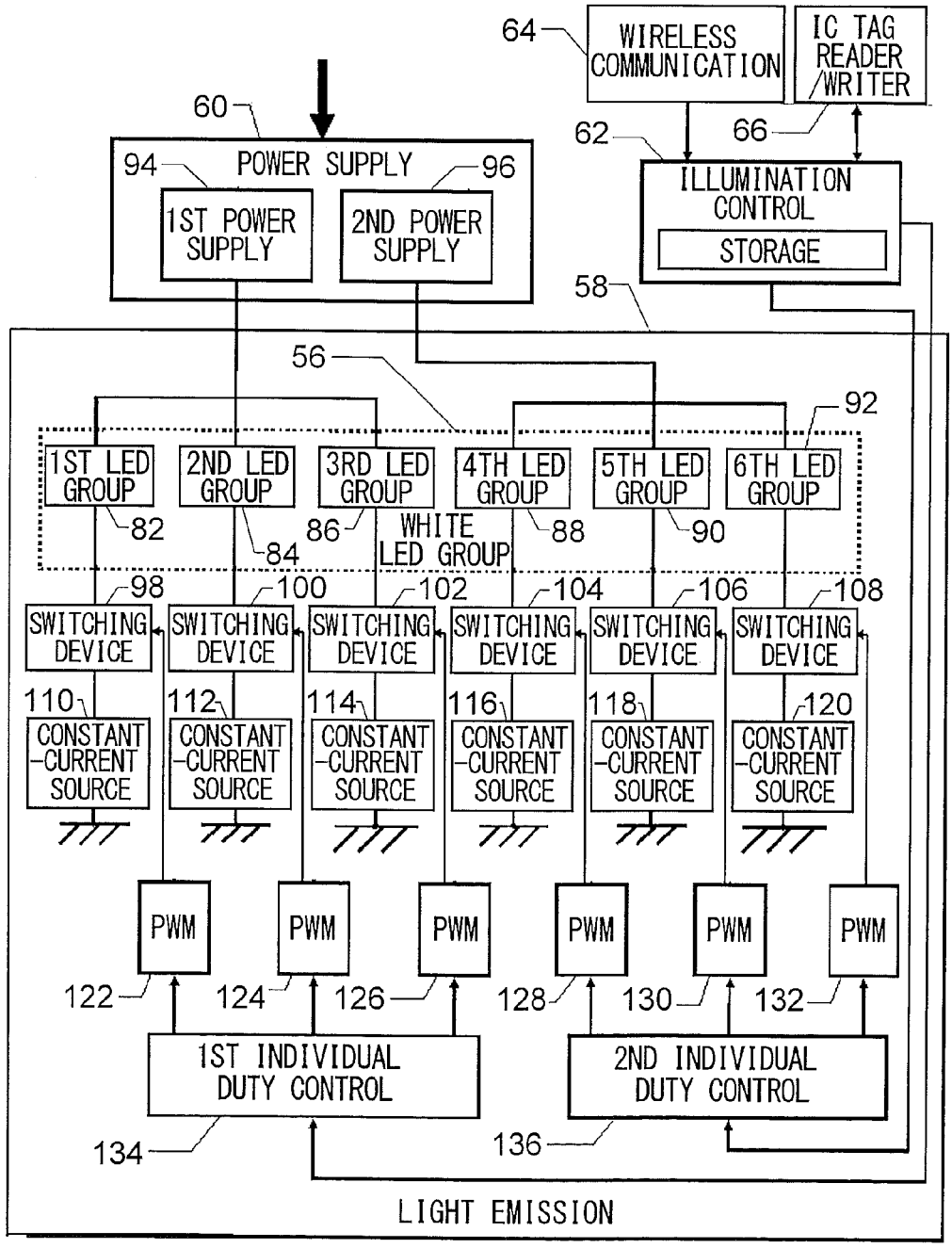
FIG. 4 is a block diagram showing a detailed configuration of an LED illuminating lamp in Example 1.

FIG. 4 is a block diagram showing a detailed configuration of the LED illuminating lamp of Example 1. The same parts as are shown in FIG. 3 are identified by the same reference signs. The group of white LEDs 56 is divided into six LED divisions, namely a first LED group 82, a second LED group 84, a third LED group 86, a fourth LED group 88, a fifth LED group 90, and a sixth LED group 92. This permits partial control of light emission as described in connection with FIG. 1. The power supply 60 is divided into two divisions: a first power supply section 94 energizes the first, second, and third LED groups 82, 84, and 86, and a second power supply section 96 energizes the fourth, fifth, and sixth LED groups 88, 90, and 92.

The first, second, third, fourth, fifth, and sixth LED groups 82, 84, 86, 88, 90, and 92 are connected, via switching devices 98, 100, 102, 104, 106, and 108, to constant-current sources 110, 112, 114, 116, 118, and 120 respectively. Thus, by controlling the switching devices 98, 100, 102, 104 106, and 108 individually, it is possible to control the lighting states of the first, second, third, fourth, fifth, and sixth LED groups, 82, 84, 86, 88, 90, and 92 individually.

The switching devices 98, 100, 102, 104, 106, and 108 are pulse-driven by PWM control sections 122, 124, 126, 128, 130, and 132 respectively. By varying the duty cycle of the PWM control of each between 100% to 0%, it is possible to perforin light adjustment of the brightness of the first, second, third, fourth, fifth, and sixth LED groups 82, 84, 86, 88, 90, and 92 independently between fully lit and extinguished.

The duty cycles fed individually to PWM control sections 122, 124, and 126 are controlled by a first individual duty control section 134. On the other hand, the duty cycles fed individually to PWM control sections 128, 130, and 132 are controlled by a second individual duty control section 136. The first and second individual duty control sections 134 and 136 are each controlled by the illumination control section 62. With this configuration, according to remote control signals delivered from the wireless communication section 64, the lighting and extinction of the first, second, third, fourth, fifth, and sixth LED groups 82, 84, 86, 88, 90, and 92 and their brightness when lit are controlled individually. This permits lighting control with a borderline located at a midway point within an LED illuminating lamp as shown in FIG. 1.

Figure 5:
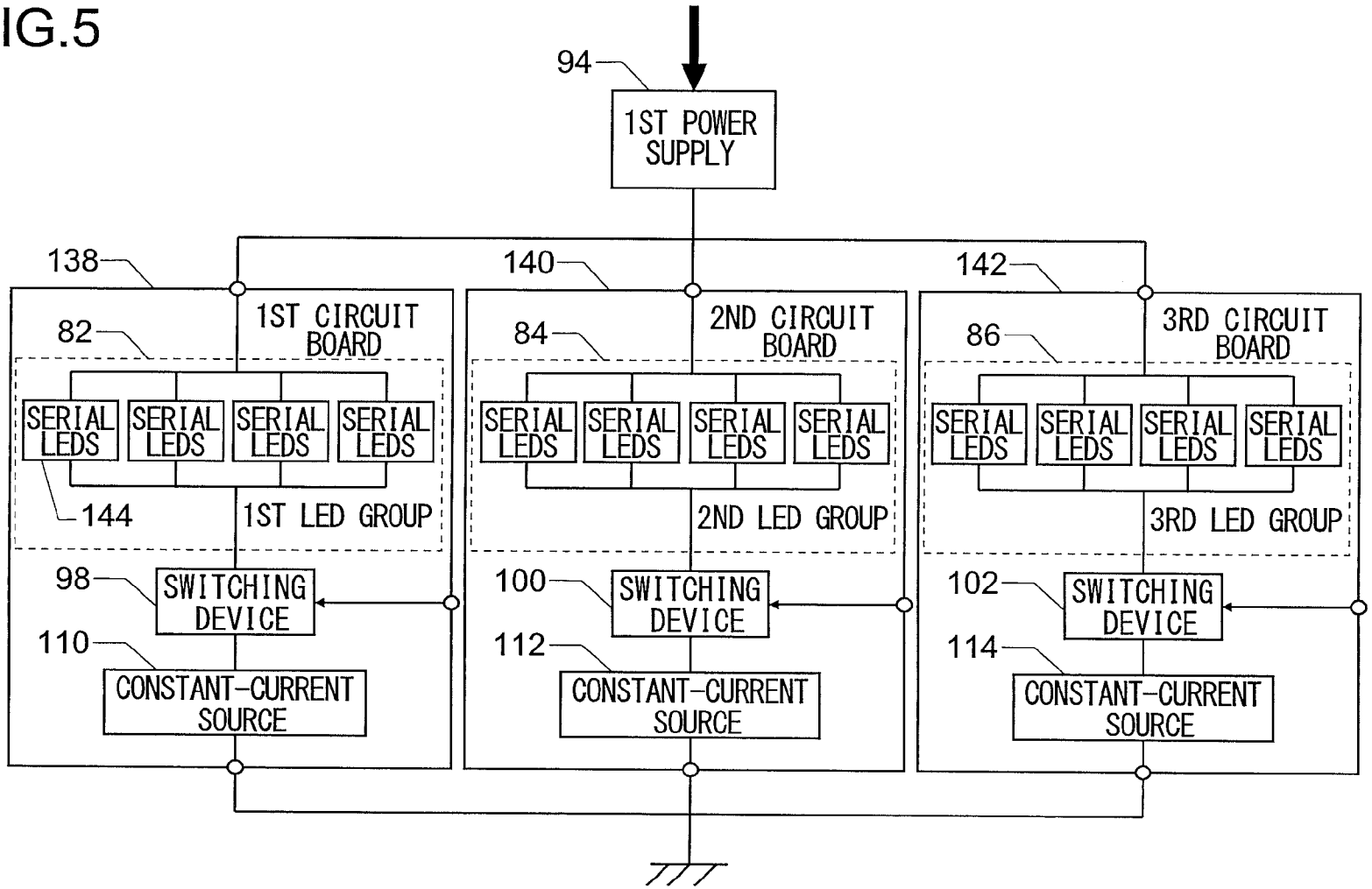
FIG. 5 is a block diagram showing a detailed configuration of white LED groups etc. in Example 1.

FIG. 5 is a block diagram showing a detailed configuration of the groups of white LEDs in Example 1. Such parts as are also shown in FIG. 4 are identified by the same reference signs. While FIG. 5 only shows the part governed by the first power supply section 94, the part governed by the second power supply section 96 is configured in a similar manner. As shown in FIG. 5, the components relevant to each group of white LEDs are put together on a single circuit board. Specifically, the components relevant to the first LED group 82 is mounted on a first circuit board 138, the components relevant to the second LED group 82 is mounted on a second circuit board 140, and the components relevant to the third LED group 86 is mounted on a third circuit board 142. Thus, the lighting and extinction of one LED illuminating lamp and its brightness when lit are controlled independently for each of six divisions on a circuit board-by-circuit board basis.

As shown in FIG. 5, the LED group within each circuit board has a circuit configuration where four series of white LEDs 144 etc. are connected in parallel. The series of white LEDs 144 etc. are each composed of 12 white LEDs connected in series. Thus, the first power supply section 94 governs a circuit configuration having three series of 12 white LEDs on each of the three circuit boards, that is, a total of 12 such series of LEDs, connected in parallel as a whole. Irrespective of whether those individual white LEDs are connected in series or in parallel electrically, they are mechanically arranged in a single row within an LED illuminating lamp. As a result, from the first LED group 82 through the sixth LED group 92, a total of 288 white LEDs are arranged in a single row within an LED illuminating lamp. As described previously, the white LED at an end of an LED illuminating lamp is located close to the white LED at the adjacent end of the next LED illuminating lamp, and this permits seamless, linear illumination.

Figure 6:
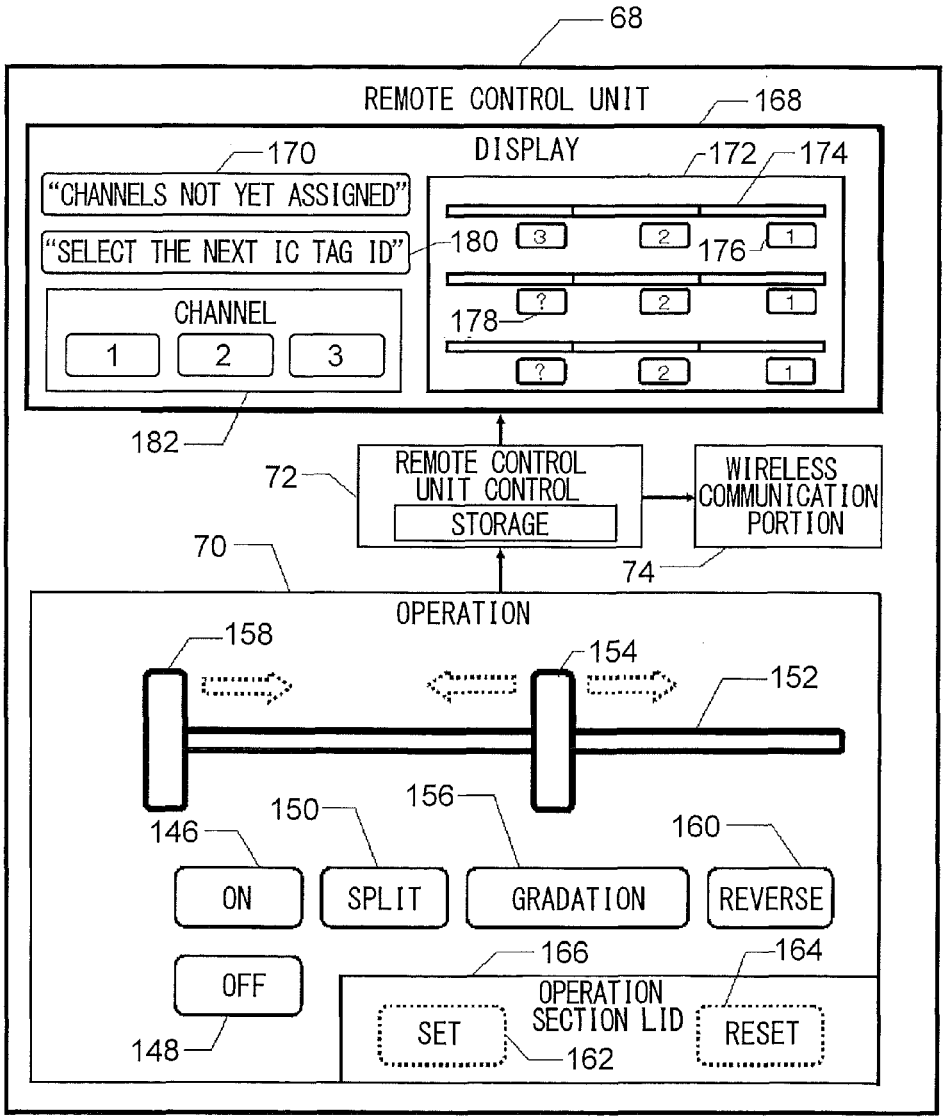
FIG. 6 is a block diagram showing a detailed configuration of a remote control unit in Example 1.

FIG. 6 is a block diagram showing a detailed configuration of the remote control unit 68 in Example 1. Such parts as are shown also in FIG. 3 are identified by the same reference signs. To turn lighting on, pressing an ON button 146 on the operation section 70 causes the remote control unit control section 72 to transmit a remote control signal demanding lighting at a duty of 100% across all channels. Likewise, pressing an OFF button 148 causes the remote control unit control section 72 to transmit a remote control signal demanding extinction across all channels.

Pressing a SPLIT button 150 causes the remote control unit control section 72 to transmit a remote control signal demanding split lighting across each channel. Specifically, across each channel, a remote control signal is transmitted such that, with respect to a first slider 154 slidable in the left/right direction in the drawing along a guide 152, the part of an LED illuminating lamp corresponding to the right side is lit at a duty of 100% and the part of an LED illuminating lamp corresponding to the left side is extinguished. The division between the lit and extinguished parts by the first slider 154 corresponds to what is shown in FIG. 1(A3), (B1), (B2), (B3), etc. The slide lever itself is continuously slidable, but when splitting occurs at a midway point within an LED illuminating lamp, the closest of the splitting points between the six divisions is detected by a contact provided in the guide 152.

Pressing a GRADATION button 156 causes the remote control unit control section 72 to transmit a remote control signal for graded lighting control across each channel. Specifically, across each channel, a remote control signal is transmitted such that lighting is graded to be increasingly dim leftward from the first slider 154. The gradation control by the first slider 154 corresponds to what is shown in FIG. 1(C1) or (C2).

In a case where, as described above, extinction or graded lighting on one side is intended, a second slider 158 is kept retracted at the left end. By contrast, when the second slider 158 is moved from its retracted position into the guide 152, a remote control signal is transmitted such that the part inside the first and second sliders 154 and 158 is lit at a duty of 100% and the part outside is extinguished or increasingly dim outward from the first and second sliders 154 and 158. While the second slider 158 is positioned out in the guide 152, the lighting condition when the GRADATION button 156 is pressed corresponds to what is shown in FIG. 1(C3). In a split or graded lighting state, sliding the first or second slider 154 or 158 provokes automatic transmission of a remote control signal that moves the reference point accordingly.

A REVERSE button 160 is pressed to reverse a lighting condition as described above with respect to the first or second slider 154 or 158. Accordingly, when the second slider 158 is retracted, pressing the REVERSE button 160 causes the part on the left of the first slider 154 to be lit at a duty of 100%. When the second slider 158 is out in the guide 152, pressing the REVERSE button 160 causes the part outside the first and second slides 154 and 158 to be lit at a duty of 100%.

The above description assumes that the LED illuminating lamps have already been assigned channels. Discussed next will be initial channel assignment performed when the LED illuminating lamps are mounted on the ceiling Channel assignment is started when a SET button 162 is pressed. Pressing a RESET button 164 causes excising channel assignments to be reset. These buttons, namely the SET button 162 and the RESET button 164, are ordinarily not used once channel assignment is done, and are therefore covered by an operation section lid 166 to prevent them from being operated inadvertently. Once made, channel assignments are stored in IC tags; thus, on a later occasion of replacing an LED illuminating lamp, no assignment operation needs to be done newly, and the channel corresponding to its position is read by the LED illuminating lamp.

The assignment of channels to IC tags is essential for the control of LED illuminating lamps in Example 1, and accordingly, so long as it is not completed yet, a message "CHANNELS NOT YET ASSIGNED" 170 keeps appearing on a display 168 to request channel assignment. When channel assignment is completed, the message "CHANNELS NOT YET ASSIGNED" 170 disappears. Pressing the SET button 162 causes a ceiling layout indication to be displayed on the display 168. This corresponds to FIG. 2, and indicates the arrangement of the IC tags mounted on the ceiling with icons 174 of LED illuminating lamps. Each icon is accompanied, close to it, by a channel assignment indication 176, 178, etc. For example, the channel assignment indication 176 indicates that the IC tag is assigned "channel 1," and the question mark "?" in the channel assignment indication 178 indicates that the IC tag has not yet been assigned a channel.

If there is any IC tag that is not assigned a channel, a message "SELECT NEXT IC TAG ID" 180 is displayed on the display 168. The display 168 has a touch screen, and pressing where the message "SELECT THE NEXT IC TAG ID" 180 is displayed causes one IC tag that is not assigned a channel to be selected. During the fitting of the holder 52, no management of the relationship between IC tag positions and IDs is done, and therefore where the selected IC tag is located on the ceiling is unknown.

By contrast, during channel assignment, only the LED illuminating lamp located at the position corresponding to the IC tag selected by pressing where the message "SELECT THE NEXT IC TAG ID" 180 is displayed is lit, and this makes it possible to know the position of the selected IC tag. After viewing the lighting state on the ceiling and confirming that the selected ID corresponds to the channel assignment indication 178, pressing "3" in a channel selection indication 182 causes channel 3 to be assigned there. This assignment operation makes the "3" appearing in the channel assignment indication 178 blink; after confirming that the assignment is correct, pressing the channel assignment indication 178 in which "3" is blinking confirms the channel assignment there. This sequence of operation is repeated until all channel assignment indications have changed from "?" to a channel number, and this completes the channel assignment. Now, the message "SELECT THE NEXT IC TAG ID" 180 and the channel selection indication 182 disappear, and so does, as described above, the message "CHANNELS NOT YET ASSIGNED" 170.

Figure 7:
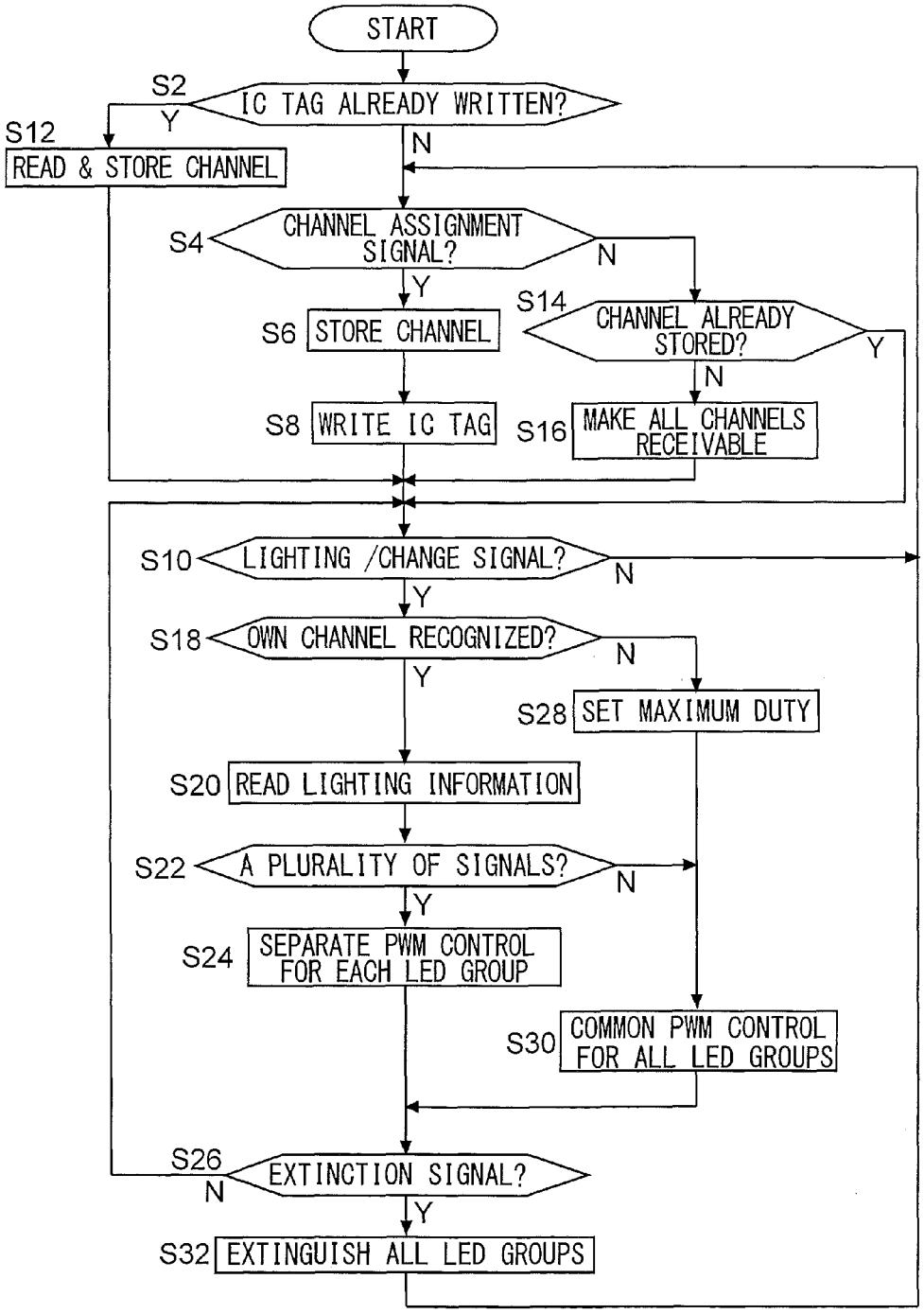
FIG. 7 is a flow chart showing the function of an illumination control section in Example 1.

FIG. 7 is a flow chart showing the functions of the illumination control section 62 of the LED illuminating lamp 4 in Example 1 shown in FIG. 3. The flow starts when the LED illuminating lamp is fitted to the holder 52. When the flow starts, first, at step S2, whether or not channel data has been written to the IC tag 19 is checked. If no channel data has been written there, then, at step S4, whether or not a channel assignment signal is being received from the remote control unit is checked; if one is being transmitted, then at step S6, the transmitted channel is preliminarily stored within the LED illuminating lamp, and then, at step S8, the transmitted channel is written to the IC tag, and then the flow proceeds to step S10.

On the other hand, if, at step S2, channel data has been written to the IC tag, the flow proceeds to step S12, where the channel is read from the IC tag and stored, and then the flow proceeds to step S10. If, at step S4, no channel assignment signal is found to be being received, then the flow proceeds to step S14, where whether or not a channel is already stored is checked. If no channel is stored yet, the flow proceeds to step S16, where all channels are made receivable so as to be ready to cope with transmission of a remote control signal from the remote control unit across any channel. On the other hand, if, at step S14, a channel is detected to have already been stored, the flow proceeds directly to step S10. In this way, a remote control signal can be coped with in any event.

At step S10, whether or not a lighting signal or any lighting state change signal has been received from the remote control unit is checked. If any has been received, the flow proceeds to step S18, where whether or not the own channel can currently be recognized is checked. A state in which the own channel can be recognized is a state in which an own channel is stored an LED illuminating lamp. If the own channel can be recognized, then the flow proceeds to step S20, where lighting information addressed to the own channel is read, and then the flow proceeds to step S22.

At step S22, it is checked whether or not the received lighting information contains a plurality of remote control signals that demand a change in the lighting state of an LED illuminating lamp at a midway point within it. If it contains a plurality of such signals, the flow proceeds to step S24, where individual PWM control of LED groups is commanded, and the flow proceeds to step S26. On the other hand, if, at step S18, no own channel is recognized, the flow proceeds to step S28, where the maximum duty is set, and then, at step S30, PWM control common to all LED groups within the illuminating lamp is commanded, and the flow proceeds to step S26. This means that, unless an own channel is recognized, so long as any lighting signal is present, irrespective of the content of a remote control signal, all LED groups together are lit at a duty of 100%. That is, so long as any remote control signal is present, even when what it specifically commands is unknown, unless it is an extinction signal, priority is given to turning lighting on in any case.

At step S26, whether or not an extinction signal has been received is checked. If one has not been received, the flow returns to step S10, and thereafter steps S10 and S18 through S26 are repeated in preparation for a next remote control signal. On the other hand, if, at step S26, an extinction signal is found to have been received, the flow proceeds to step S32, where all LED groups are extinguished, and the flow returns to step S4. Also if, at step S10, no lighting signal or change signal is found to have been received, the flow returns to step S4. In this way, with the functions at steps S4 through S10 and S14 through S32, a variety of changes in situation can be coped with.

Figure 8:
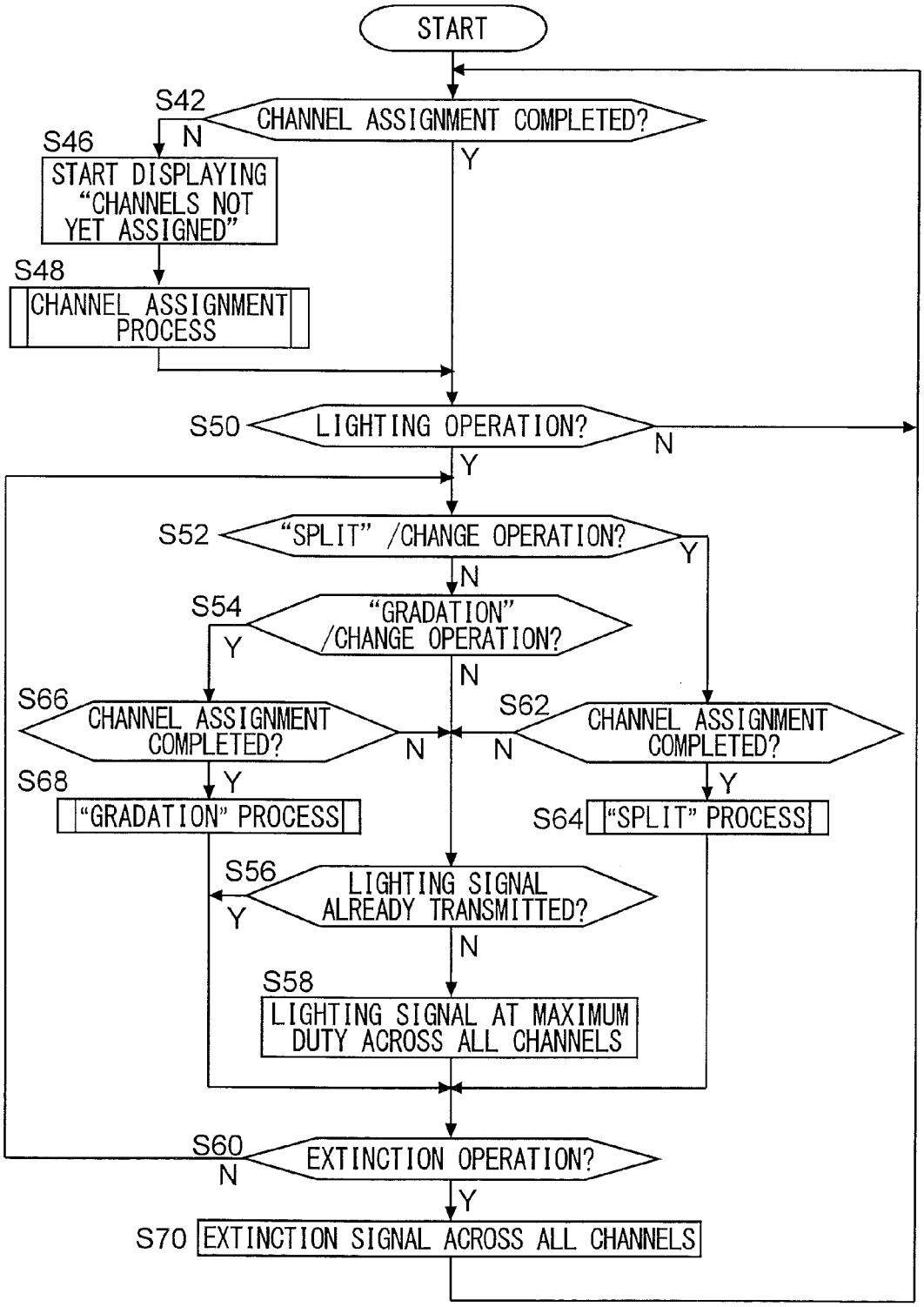
FIG. 8 is a basic flow chart showing the function of a remote control unit in Example 1.

FIG. 8 is a basic flow chart showing the functions of the remote control unit control section 72 in the remote control unit 68 in Example 1 shown in FIG. 3. The flow starts when the remote control unit 68 starts to be energized as by being loaded with a battery. When the flow starts, at step S42, whether or not channel assignment has been completed is checked. If it has been completed, the flow proceeds to step S50. On the other hand, if, at step S42, channel assignment is not found to have been completed, the flow proceeds to step S46, where the display 168 starts to display the message "CHANNELS NOT YET ASSIGNED," and then, at step S48, a channel assignment process is started. On completion of the channel assignment process, the flow proceeds to step S50. As will be described later, the channel assignment process at step S48 immediately ends if no assignment start operation is made within a predetermined period of time. In that case, the channels-not-yet-assigned state continues. The details of the channel assignment process will be given later.

At step S50, whether or not a lighting operation has been made is checked. If no lighting operation is detected, the flow returns to step S42, and thereafter steps S42 through S50 are repeated so that a lighting operation or, if necessary, a channel assignment operation is waited for. If, at step S50, a lighting operation is detected, the flow proceeds to step S52, where whether or not a "split" operation or a splitting change operation has been made is checked. If no such operation is detected, the flow proceeds to step S54, where whether or not a "gradation" or a gradation change operation has been made is checked. If no such operation is detected, the flow proceeds to step S56, where whether or not a lighting signal has been transmitted is checked. If none been transmitted yet, the flow proceeds to step S58, where transmission of a signal demanding lighting at the maximum duty across all channels is commanded, and the flow proceeds to step S60. On the other hand, if, at step S56, a lighting signal is found to have already been transmitted, the flow proceeds directly to step S60. Step S56 is necessary when, as will be described later, the flow returns to step S52 and reaches step S56 again.

On the other hand, if, at step S52, a "split" operation or a splitting change operation is found to have been made, the flow proceeds to step S62, where whether or not channel assignment has been completed is checked. If channel assignment has been completed, the flow proceeds to step S64, where a "split" process for split lighting is performed, and then the flow proceeds to step S60. The details of the "split" process will be given later. On the other hand, if, at step S62, channel assignment is not found to have been completed, no channel-by-channel control is possible, and therefore the flow proceeds to step S56. That is, in this case, no "split" or change operation is valid.

If, at step S54, a "gradation" operation or a gradation change operation is found to have been made, the flow proceeds to step S66, where whether or not channel assignment has been completed is checked. If channel assignment has already been completed, the flow proceeds to step S68, where a "gradation" process for graded lighting is performed, and then the flow proceeds to step S60. The details of the "gradation" process will be given later. On the other hand, if, at step S66, channel assignment is not found to have been completed, no channel-by-channel control is possible, and therefore the flow proceeds to step S56. That is, in this case, no "gradation" or change operation is valid.

At step S60, whether or not an extinction operation has been made is checked. If no such operation is detected, the flow returns to step S52, and thereafter steps S52 through S64 are repeated as necessary to cope with a variety of situations. Meanwhile, if no operation is made, the flow repeats the loop from step S52 to S54 to S56 to S60 back to S52, and no remote control signal is transmitted; thus, no change occurs in the lighting state of the LED illuminating lamp. On the other hand, if, at step S60, an extinction operation is detected, then, at step S70, transmission of an extinction signal across all channels is commanded, and the flow returns to step S42. Thereafter, steps S42 through S70 are repeated as necessary to cope with a variety of remote control operations.

Figure 9:
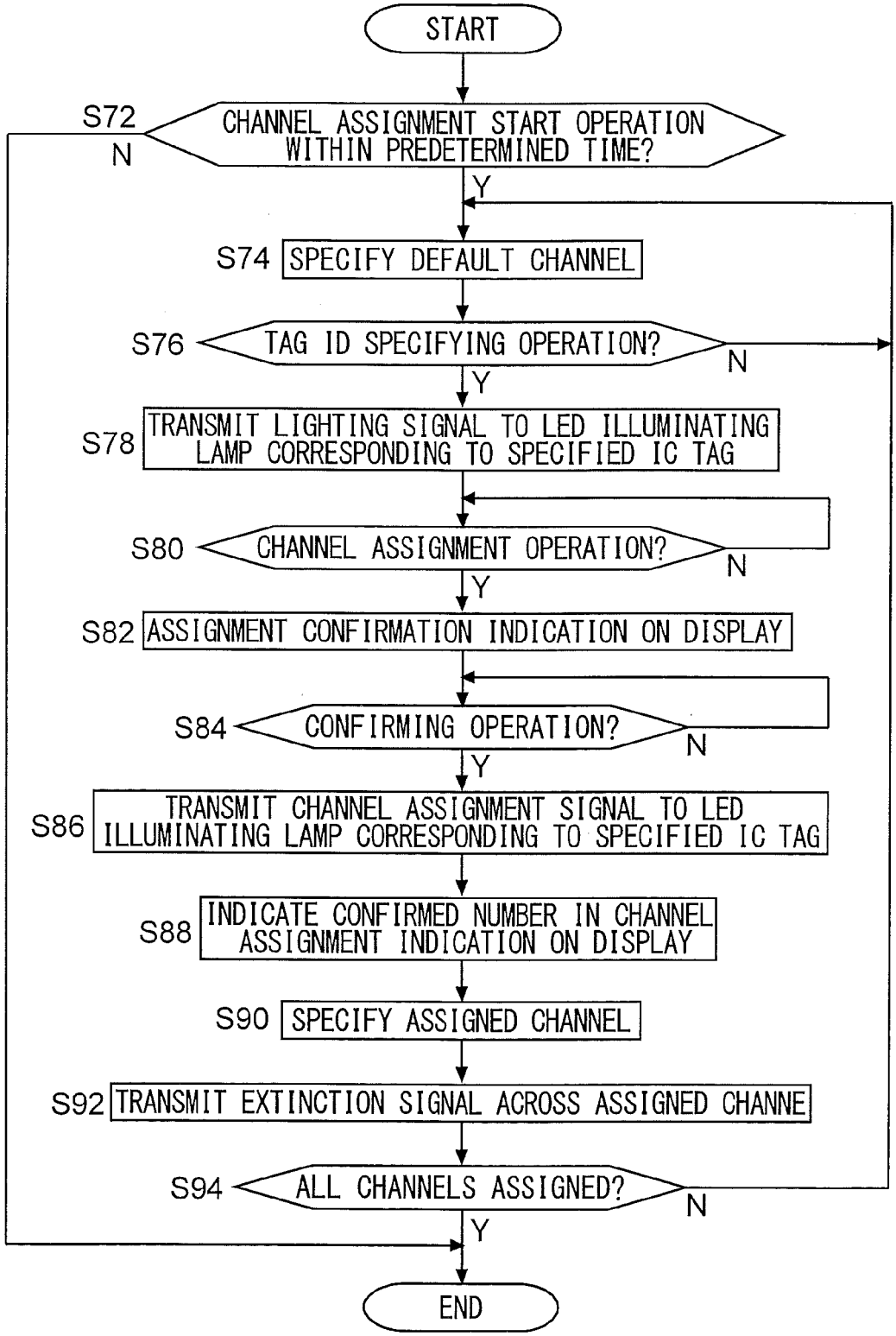
FIG. 9 is a flow chart showing the details of step S48 in FIG. 8.

FIG. 9 is a flow chart showing the details of the channel assignment process at step S48 in FIG. 8. When the flow starts, at step S72, whether or not the SET button 162 has been operated to start a channel assignment start operation within a predetermined period of time is checked. If that operation is detected, the flow proceeds to step S74, where a predetermined channel is specified by default. If no channel assignment has been done, step S16 in FIG. 7 has made the LED illuminating lamp receivable across all channels, and therefore the default channel may be any. Next, at step S76, whether or not the "SELECT NEXT IC TAG ID" part on the touch screen of the display has been operated to make a tag ID specification operation is checked, and if such an operation is detected, the flow proceeds to step S78. On the other hand, if, at step S76, no such operation is detected, the flow returns to step S74, and thereafter steps S74 and S76 are repeated so that an operation is waited for.

At step S78, a lighting signal is transmitted to the LED illuminating lamp corresponding to the IC tag specified by the ID. This identifies the position of the IC tag specified. The flow then proceeds to step S80, where, after confirming the position of the LED illuminating lamp lit, a channel assignment operation is waited for. When a channel assignment operation is detected, the flow proceeds to step S82, where the assigned channel number is blinked in the channel assignment indication on the display 168 as an indication for requesting confirmation of the assignment. Next, at step S84, a confirmation operation is waited for, and, when one is detected, the flow proceeds to step S86.

At step S86, a channel assignment signal confirmed as described above is transmitted to the LED illuminating lamp corresponding to the specified IC tag. This channel assignment signal is the one that is written to the specified IC tag at step S8 in FIG. 7. Next, at step S88, the blinking of the channel assignment indication on the display 168 is stopped, and the confirmed channel number is displayed.

Next, at step S90, the assigned channel is specified, and then, at step S92, an extinction signal is transmitted across that assigned channel This corresponds to extinguishing the LED illuminating lamp lit at step S78, and the extinction here is done by selecting the channel instead of the IC tag ID with the simultaneous purpose of confirming the channel assignment. The flow then proceeds to step S94, where whether or not all IC tags have been assigned channels. If there remains any IC tag that is not assigned a channel, the flow returns to step S74, and thereafter, for the next IC tag, the steps starting with step S74 are repeated. On the other hand, if, at step S94, all channel assignment is found to have been done, the flow ends. If, at step S72, no channel assignment start operation is detected within the predetermined period of time, the flow immediately ends.

Figure 10:
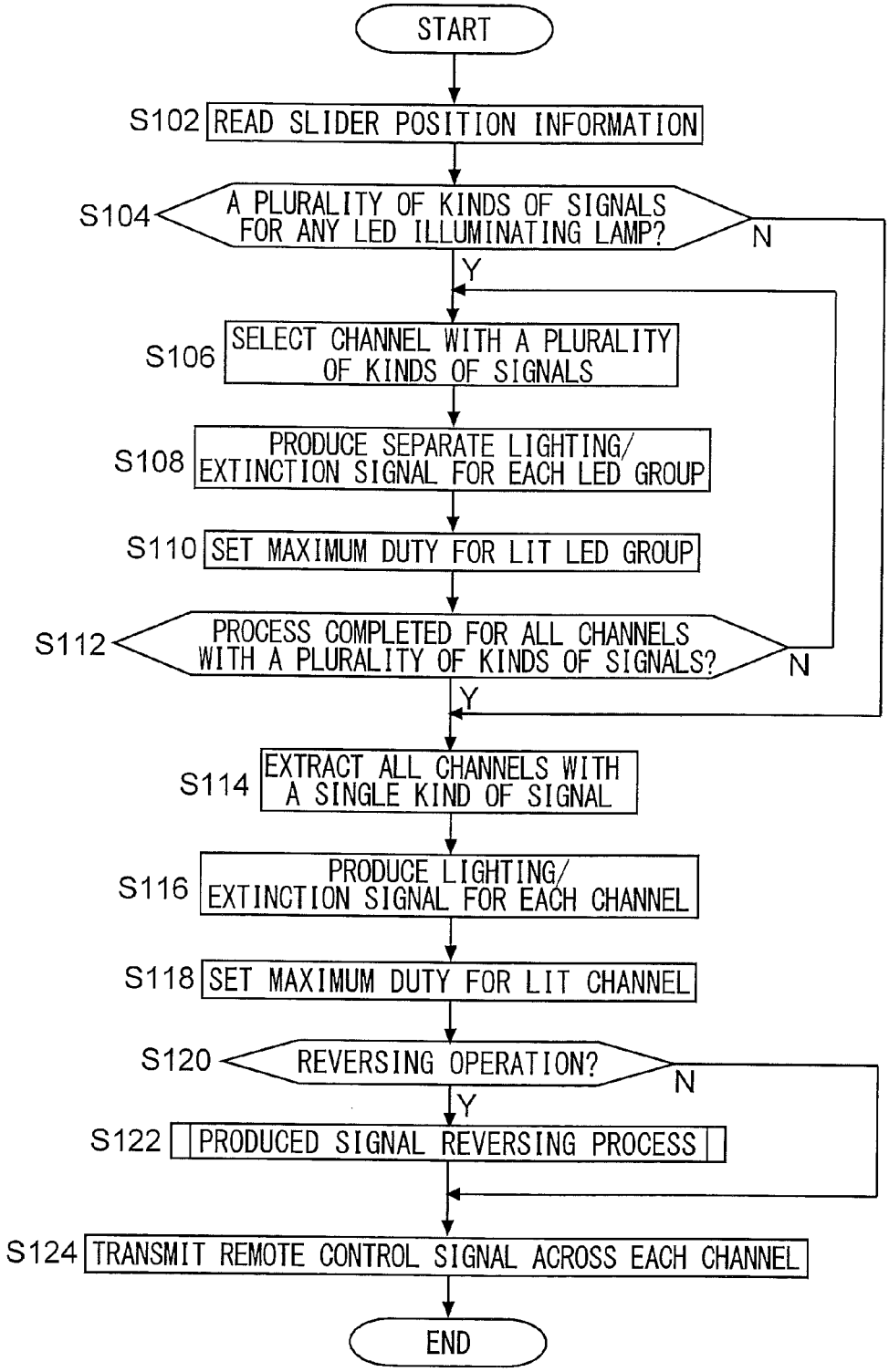
FIG. 10 is a flow chart showing the details of step S64 in FIG. 8.

FIG. 10 is a flow chart showing the details of the "split" process at step S64 in FIG. 8. When the flow starts, at step S102, slider position information is read. Next, at step S104, it is checked whether or not there is any LED illuminating lamp for which a plurality of kinds of lighting signals have been issued. This corresponds to a check of whether or not a slider is positioned at a position demanding a change in lighting state at a midway point within any LED illuminating lamp, and thus the check can be made according to the information read at step S102. In the "split" process, "a plurality of kinds" include a lighting signal and an extinction signal, and correspond to cases where part of an LED illuminating lamp is lit and another part is extinguished. If, at step S104, such a case is detected, the flow proceeds to step S106, where one channel across which a plurality of kinds of lighting signals are issued is selected.

Next, at step S108, for the selected channel, an independent lighting or extinction signal is produced for each of the six LED groups individually. Then, at step S110, for the LED groups to be lit, the maximum duty is set. Then, the flow proceeds to step S112, where, for all the channels across which a plurality of lighting signals are issued, whether or not the process from step S106 through step S110 has been completed is checked. If there is any channel for which the process still has to be performed, the flow returns to step S106 so that a similar process is performed for the next channel. On the other hand, if, at step S112, the process has been completed for all channels, the flow proceeds to step S114. If, at step S104, no LED illuminating lamp is detected for which a plurality of lighting signals are issued, the flow immediately proceeds to step S114.

At step S114, all the channels across which only a single kind of remote control signal, namely a lighting or extinction signal, is issued are selected. Then, at step S116, for each of those channels, a lighting or extinction signal is produced. Then, at step S118, for the channels to be lit, the maximum duty is set, and the flow proceeds to step S120.

At step S120, whether or not a reversing operation has been made is checked, and if such an operation is detected, the flow proceeds to step S122, where a process for reversing the produced signals is performed, and the flow proceeds to step S124. On the other hand, if, at step S120, no reversing operation is detected, the flow proceeds directly to step S124. At step S124, the remote control signals thus produced are transmitted across the relevant channels, and the flow ends.

Figure 11:
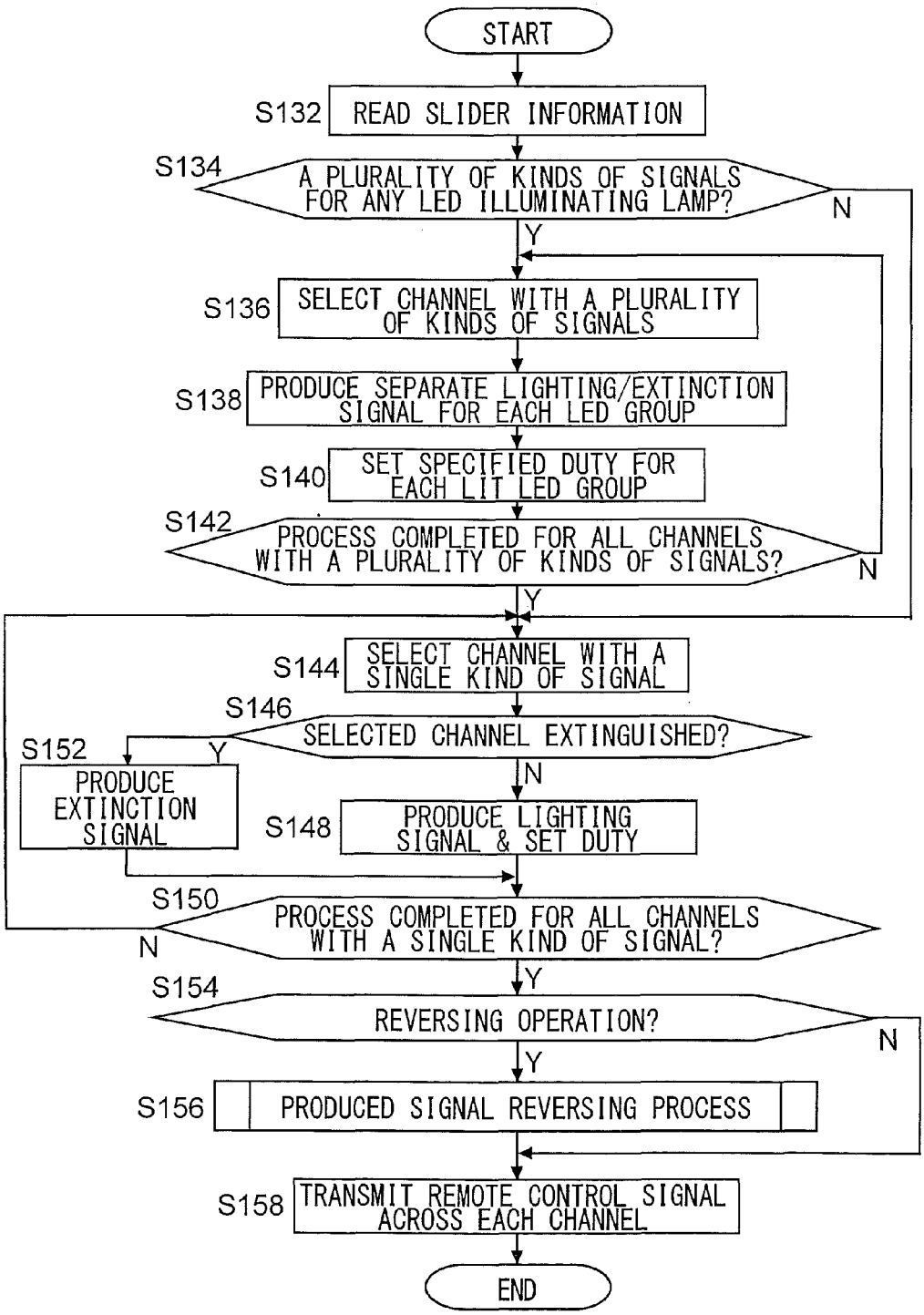
FIG. 11 is a flow chart showing the details of step S68 in FIG. 8.

FIG. 11 is a flow chart showing the details of the "gradation" process at step S68 in FIG. 8. When the flow starts, at step S132, slider position information is read. Next, at step S134, it is checked whether or not there is any LED illuminating lamp for which a plurality of kinds of lighting signals are issued. In the "gradation" process, "a plurality of kinds" include, in addition to a lighting signal and an extinction signal, lighting signals of different duties. If, at step S134, such a case is detected, the flow proceeds to step S136, where one channel for which a plurality of kinds of lighting signals are issued is selected.

Next, at step S138, for the selected channel, an independent lighting or extinction signal is produced for each of the six LED groups individually. Then, at step S140, for each of the LED groups to be lit, the specified duty is set. Then, the flow proceeds to step S142, where, for all the channels for which a plurality of kinds of lighting signals are issued, whether or not the process from step S106 through step S110 has been completed is checked. If there is any channel for which the process still has to be performed, the flow returns to step S136, where, for the next channel, a similar process is performed. On the other hand, if, at step S142, the process has been completed for all the channels, the flow proceeds to step S144. If, at step S134, no LED illuminating lamp for which a plurality of kinds of lighting signals are issued is detected, the flow immediately proceeds to S144.

At step S44, one channel for which only a single kind of lighting signal is issued is selected. Next, at step S146, whether or not to set an extinction signal for the selected channel is checked. If that is not the case, the flow proceeds to step S148, where, for the selected channel, a lighting signal is produced and the specified duty is set, and then the flow proceeds to step S150. On the other hand, if, at step S146, it is detected that an extinction signal is to be set for the selected channel, the flow proceeds to step S152, where an extinction signal is produced, and the flow proceeds to step S150. At step S150, for all the channels for which a single kind of lighting signal is issued, whether or not the process from steps S144 through S148 or S152 has been completed is checked. If there is any channel for which the process has not been completed yet, the flow returns to step S144, where, for the next channel, a similar process is performed. On the other hand, if, at step S150, the process has been completed for all the channels, the flow proceeds to step S154.

At step S154, whether or not a reversing operation has been made is checked, and if such an operation is detected, the flow proceeds to step S156, where a process for reversing the produced signals is performed, and then the flow proceeds to step S124. On the other hand, if, at step S154, no reversing operation is detected, the flow proceeds directly to step S158. At step S158, the remote control signals produced as described above are transmitted across the relevant channels, and the flow ends.

Example 2

Figure 12:
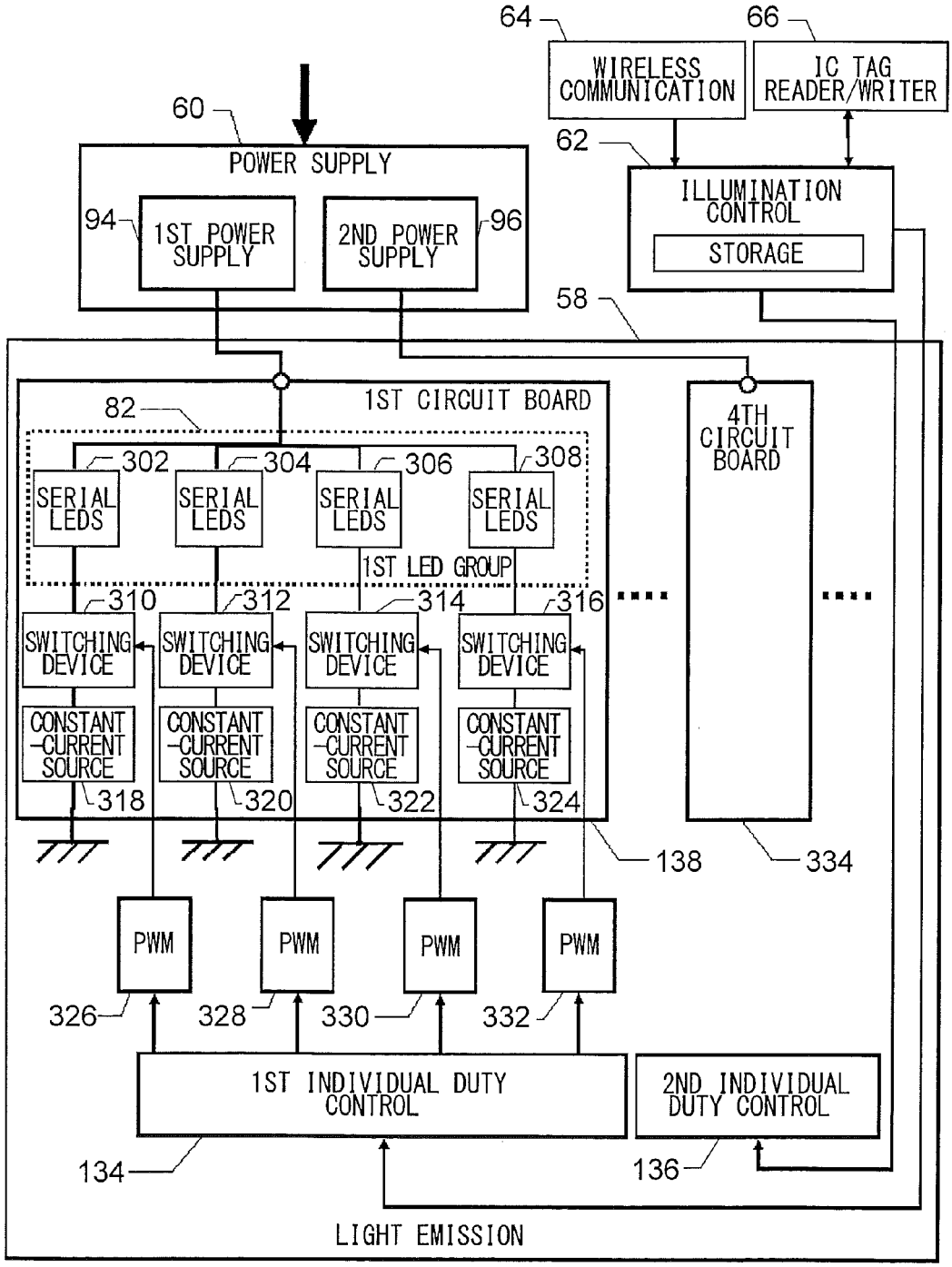
FIG. 12 is a block diagram showing a detailed configuration of an LED illuminating lamp of Example 2 (Example 2)

FIG. 12 is a block diagram showing a detailed configuration of an LED illuminating lamp in Example 2 of the invention. For the LED illuminating lamp of Example 2, exterior views of its lighting states and arrangement diagrams of how it is mounted on the ceiling are common with Example 1 shown in FIGS. 1 and 2. Moreover, a block diagram schematically showing a section of a principal portion is also common with Example 1 shown in FIG. 3. Furthermore, a detailed configuration of the LED illuminating lamp has much common with Example 1 shown in FIG. 4; accordingly, mutually corresponding parts are identified with the same reference signs, and no overlapping description will be repeated.

The LED illuminating lamp of Example 2 shown in FIG. 12 differs from that of Example 1 shown in FIG. 4 in that, while in Example 1, the LED groups are PWM-controlled each independently on a group-by-group basis, in Example 2, the series of white LEDs are PWM controlled each independently on a series-by-series basis. This makes it possible to control the lighting of the LED illuminating lamp for each of the 24 divisions independently; it is thus possible to change borderlines between lit and extinguished parts more finely and to change gradations more smoothly. This will be understood easily by comparing the first circuit board 138 in Example 1 shown in FIG. 5 and that in Example 2 shown in FIG. 12.

Specifically, a series of white LEDs 302, 304, 306, and 308 constituting a first LED group is connected via switching devices 310, 312, 314, and 316 to constant-current sources 318, 320, 322, and 324 respectively. Thus, by controlling the switching devices 310, 312, 314, and 316 individually, it is possible to control the lighting states of the series of white LEDs 302, 304, 306, and 308 individually.

The switching devices 310, 312, 314, and 316 are pulse-driven by PWM control sections 326, 328, 330, and 332 respectively, and by varying the duty cycles in their respective PWM control between 100% and 0%, it is possible to perform light adjustment of the brightness of the series of white LEDs 302, 304, 306, and 308 independently. The duty cycles given individually to the PWM control sections 326, 328, 330, and 332 are controlled by a first individual duty control section 134.

A second circuit board 140 and a third circuit board 142, which are energized by a first power supply section 94 and controlled by the first individual duty control section 134, have the same configuration as the first circuit board 138, and therefore, for the sake of simplicity, they are omitted from illustration. Three other circuit boards, which are energized by a second power supply section 96 and controlled by a second individual duty control section 136, also have a similar configuration, and therefore only the fourth circuit board 334 is illustrated, with the other two omitted and with no detailed configuration illustrated for the fourth circuit board 334.

Example 3

Figure 13:
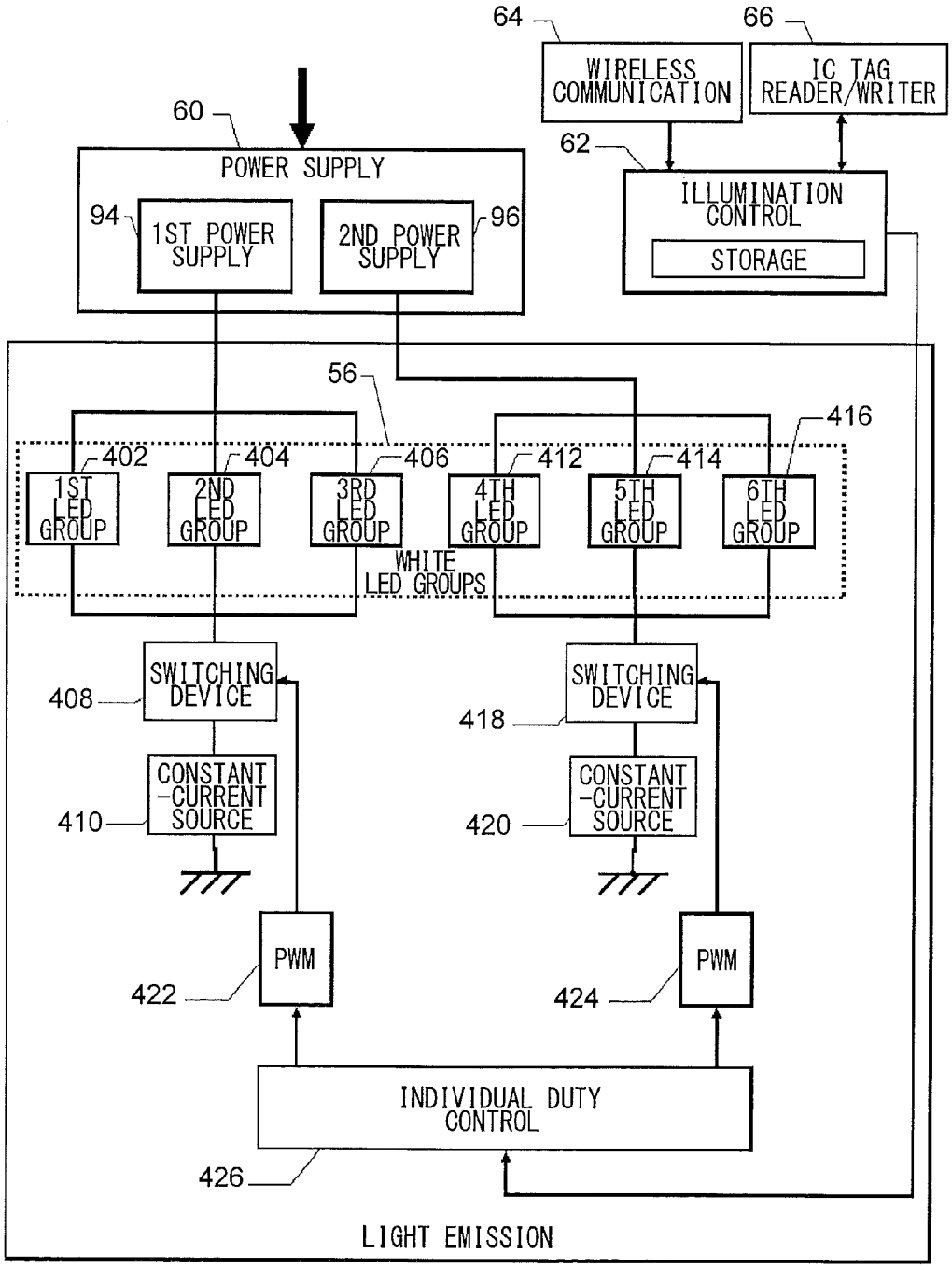
FIG. 13 is a block diagram showing a detailed configuration of an LED illuminating lamp of Example 3 (Example 3)

FIG. 13 is a block diagram showing a detailed configuration of an LED illuminating lamp in an illuminating device of Example 3 of the invention. Also for the LED illuminating lamp of Example 3, exterior views of its lighting states and arrangement diagrams of how it is mounted on the ceiling are common with Example 1 shown in FIGS. 1 and 2. Moreover, a block diagram schematically showing a section of a principal portion is also common with Example 1 shown in FIG. 3. Furthermore, a detailed configuration of the LED illuminating lamp has much common with Example 1 shown in FIG. 4; accordingly, mutually corresponding parts are identified with the same reference signs, and no overlapping description will be repeated.

The LED illuminating lamp of Example 3 shown in FIG. 13 differs from that of Example 1 shown in FIG. 4 in that, while in Example 1, the LED groups are PWM-controlled independently on a group-by-group basis, in Example 3, they are controlled independently on a power supply section-by-power supply section basis. This permits the lighting of the LED illuminating lamp to be controlled independently for each of two split parts. Thus, while splitting is coarser in Example 3, performing PWM control on a power supply section-by-power supply section basis helps achieve an extremely simple construction; moreover, light adjustment is possible independently for each unit of half the length of the LED illuminating lamp, and thus the benefits of the present invention can be obtained. This will be understood better by comparing Example 1 shown in FIG. 4 and Example 3 shown in FIG. 13.

Specifically, a first, a second, and a third LED group 402, 404, and 406, which are energized by a first power supply section, are parallel-connected together, and are connected via a switching device 408 to a constant-current source 410. On the other hand, a fourth, a fifth, and a sixth LED group 412, 414, and 416, which are energized by a second power supply section 96, are parallel-connected together, and are connected via a switching device 418 to a constant-current source 420. Thus, by controlling the switching devices 408 and 418 individually, it is possible to control individually the lighting states of the LED groups energized by the first power supply section 94 and the LED groups energized by the second power supply section 96.

The switching devices 408 and 418 are pulse-driven by PWM control sections 422 and 424 respectively. By varying the duty cycle of the PWM control of each between 100% and 0%, it is possible to achieve light adjustment of the brightness of the LED groups between fully lit and extinguished for each power supply section. The duty cycles fed individually to the PWM control sections 422 and 424 are controlled by an individual duty control section 426.

Example 4

Figure 14:
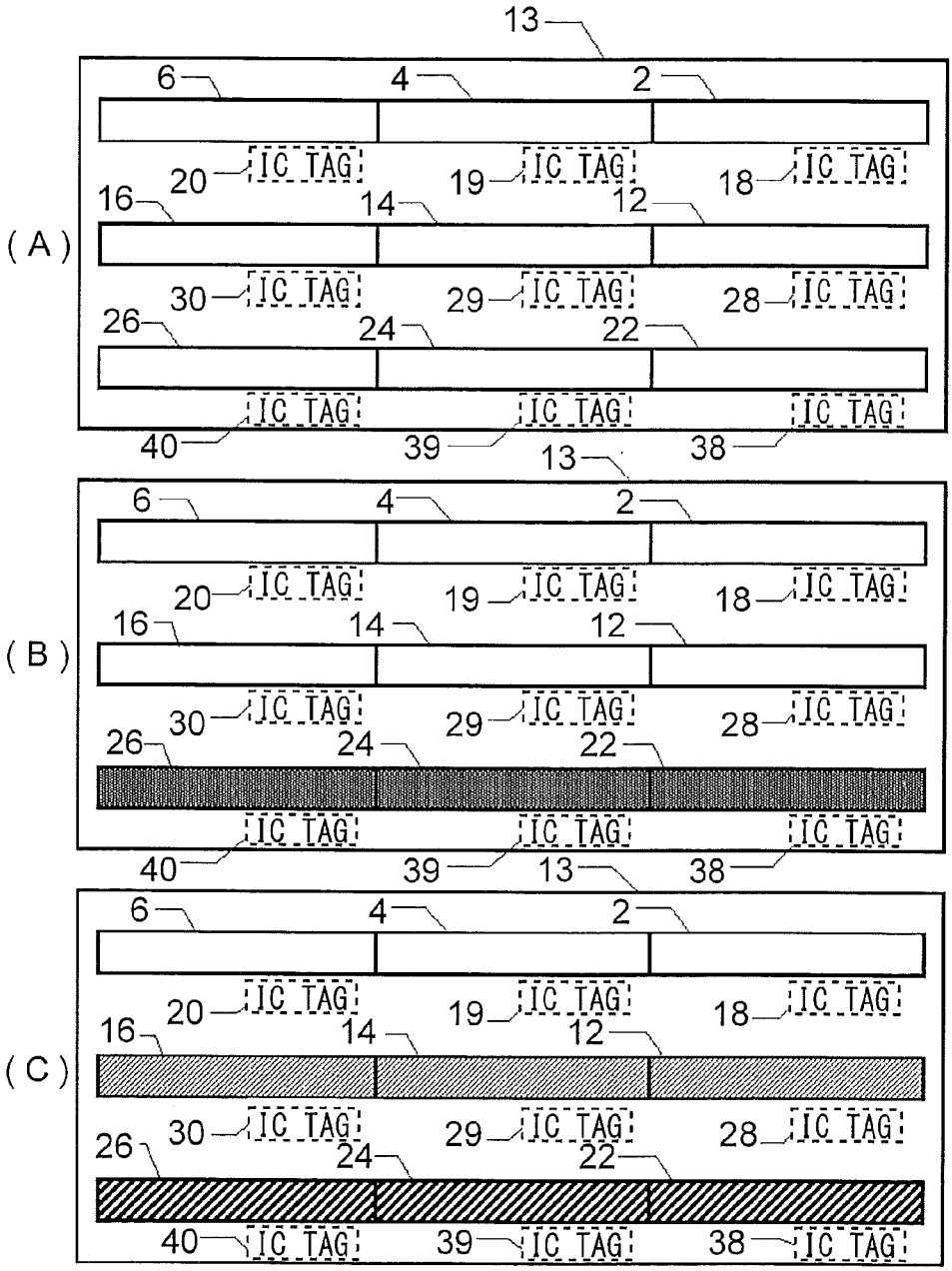
FIG. 14 comprises ceiling arrangement diagrams of an illuminating device in different lighting conditions in Example 4 of the invention (Example 4)

FIG. 14 comprises ceiling arrangement diagrams of an illuminating device of Example 4 of the invention in different lighting states as viewed, as in FIG. 2, from below the ceiling 13. In configuration, Example 4 is similar to Example 1. However, the use situation differs here, and accordingly the channel assignment differs. To avoid confusion, therefore, a separate description will be given for Example 4. Specifically, Example 1 in FIG. 2 is suitable in situations where illumination conditions differ between the left and right sides of the diagrams, for example for illumination in a lecture hall where a projection screen for a projector is placed at the left side of the figure and audience seats are placed at the right side, or for illumination in a room a window at the left side of the figure. In contrast, Example 4 in FIG. 14 is suitable in cases where illumination conditions differ between the upper and lower parts of the diagrams. To cope with such situations, in Example 4, channel assignment is done as follows: the row of LED illuminating lamps 2, 4, and 6 is assigned channel 1, the row of LED illuminating lamps 12, 14, and 16 is assigned channel 2, and the row of LED illuminating lamps 22, 24, and 26 is assigned channel 3.

FIG. 14(A), like FIG. 2(A1), shows a state in which all the LED illuminating lamps are lit. In this case, a signal demanding the lighting of all LED illuminating lamps at a duty of 100% is transmitted across all channels. In FIG. 14(B), of three rows of LED illuminating lamps, while the row of LED illuminating lamps 2, 4, and 6 and the row of LED illuminating lamps 12, 14, and 16 are lit, the row of LED illuminating lamps 22, 24, and 26 is extinguished. To achieve this lighting state, a signal demanding the lighting of all LED illuminating lamps at a duty of 100% is transmitted across channels 1 and 2, and an extinction signal is transmitted across channel 3. A lighting state like that shown in FIG. 14(B) is suitable, for example, for illumination in a lecture hall where a projection screen for a projector is placed at the bottom side of FIG. 14 and audience seats are placed at the top side.

FIG. 14(C) shows a state in which graded illumination is provided such that the three rows of LED illuminating lamps are increasingly dim downward. To achieve this lighting state, a signal demanding lighting at a duty of 100% is transmitted across channel 1, a signal demanding lighting at a duty of 50% is transmitted across channel 2, and a signal demanding lighting at a duty of 13% is transmitted across channel 3. A lighting state like that shown in FIG. 2(C) is suitable, for example, for illumination in a room with a window at the bottom side of FIG. 14.

As described above, Examples 1 and 4 differ only in channel assignment, that is, in whether to assign a common channel to LED illuminating lamps arranged in the vertical direction or to assign a common channel to LED illuminating lamps arranged in the horizontal direction. Instead of assigning a common channel to a plurality of LED illuminating lamps, assigning different channels to individual LED illuminating lamps makes it possible to control the lighting states in FIG. 2 or 14 freely. Examples of such control will be described later.

Example 5

Figure 15:
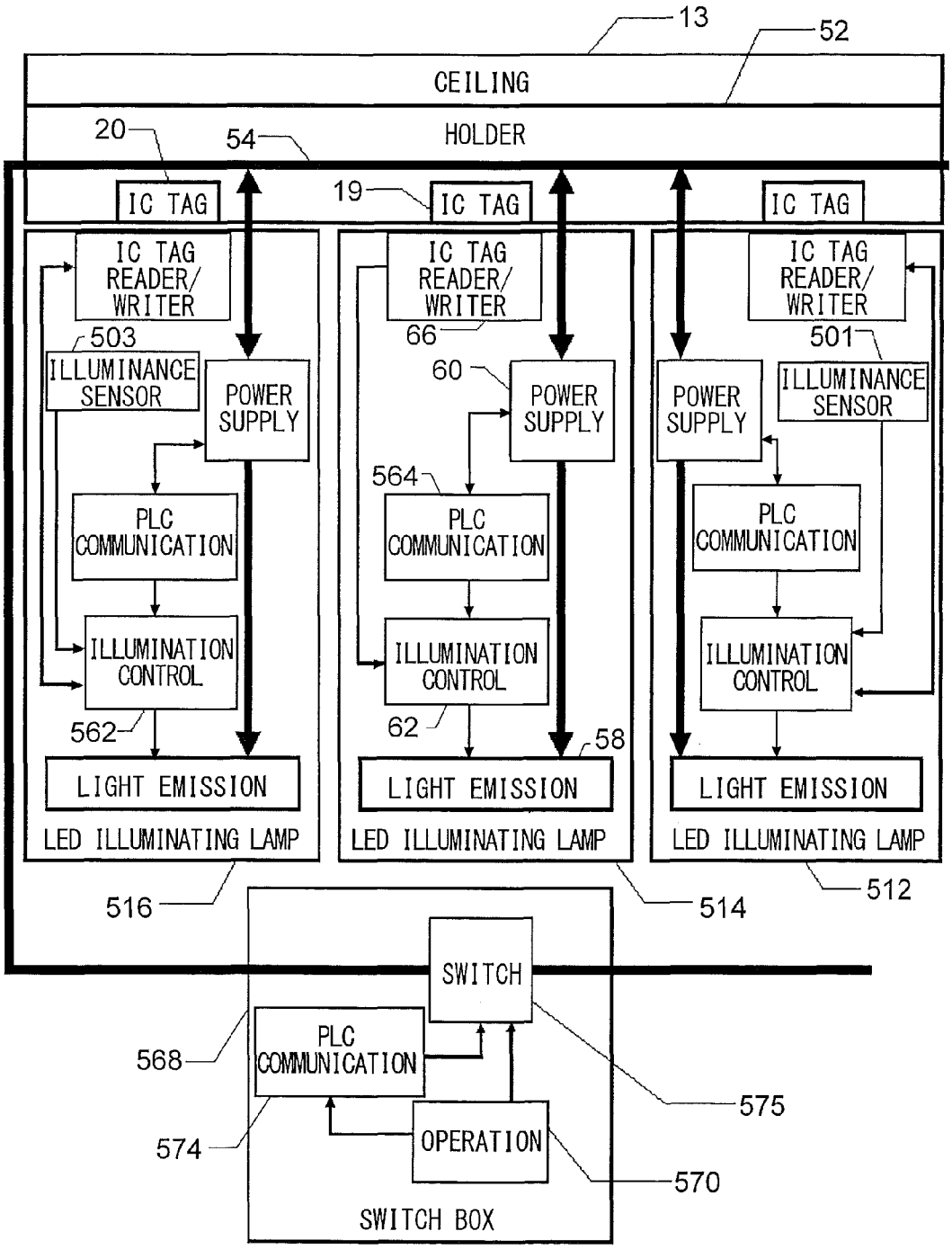
FIG. 15 is a block diagram schematically showing a principal part of Example 5 of the invention (Example 5)

FIG. 15 is a block diagram schematically showing a principal portion of an illuminating device of Example 5 of the invention. Such parts as are common with Example 1 in FIG. 3 are identified by the same reference signs, and no overlapping description will be repeated. In Example 5, channel assignment is done in a similar manner as in Example 1, assigning a common channel to a group of LED illuminating lamps arranged in the vertical direction. Accordingly, its lighting states are, as in Example 1, as shown in FIG. 2. Arranged at the center of the row of LED illuminating lamps is an LED illuminating lamp 514, which has substantially the same configuration as in Example 1 in FIG. 3, but conducts external communication by high-speed power-line communication (PLC) via a cable 54, and is provided with a PLC communication section 564, such as a modem, connected to a power supply 60.

Like the LED illuminating lamps 2, 12, and 22 in the Example in FIG. 3, an LED illuminating lamp 512 is arranged at the right end of the row of LED illuminating lamps. The LED illuminating lamp 512 has a configuration similar to the LED illuminating lamp 514, and additionally has, in a right-end portion thereof, an illuminance sensor 501. This is for measuring the brightness of the row of LED illuminating lamps in a right-end portion thereof. On the other hand, like the LED illuminating lamps 6, 16, and 26 in the Example in FIG. 3, an LED illuminating lamp 516 is arranged at the left end of the row of LED illuminating lamps. The LED illuminating lamp 516 has a configuration similar to the LED illuminating lamp 514, and additionally has, in a left-end portion thereof, an illuminance sensor 503. This is for measuring the brightness of the row of LED illuminating lamps in a left-end portion thereof.

As described above, the LED illuminating lamps 512, 514, and 516 are arranged in a row, and have the capability of measuring brightness at both ends of the row. The aim is to automatically achieve illumination with uniform lightness in a room, as in a case where a room has a window at the left side as in FIG. 2 and outside light enters it from the left side during the day. Specifically, during the day, the window-side illuminance sensor 503 receives outside light and indicates higher illuminance than the off-window illuminance sensor 501 where there is no window. In Example 5, based on a result of automatic calculation of the difference in illuminance, lighting as shown in FIG. 2(2C) is provided; that is, lighting intensity in an window-side area is reduced so as to achieve control such that the sum of the light of LED illuminating lamps and outside light is equal in window-side and off-window areas. The PLC communication sections 564 of the LED illuminating lamps 512, 514, and 516 exchange the outputs of the luminance sensors and the lighting duty information by PLC communication via the cable 54. These capabilities are managed by one of the illumination control sections (for example, the illumination control section 562 of the LED illuminating lamp 516) serving as a main control section which comprehensively controls all the LED illuminating lamps.

In Example 5, since a common channel is assigned to a group of LED illuminating lamps arranged in the vertical direction, the illuminance sensors 501 and 503 do not necessarily have to be provided at the LED illuminating lamps at the left and right ends of each row of LED illuminating lamps; for example, they may be provided only in the row of LED illuminating lamps at the center, with other rows lit according to similar duty information transmitted across a common channel. By assigning individual channels to individual LED illuminating lamps, and providing illuminance sensors at the left and right ends of each row of LED illuminating lamps, it is possible to achieve fine control for each row according to the difference in luminance there.

As described above, in Example 5 in FIG. 15, duty control is performed autonomously by the illumination control section 562 of the LED illuminating lamp 516 etc. Thus, a switch box 568 assumes the function of a wired at-hand switch for turning on and off the supply of electric power to the cable 54 by means of a switch 575 according to operation on an operation section 570. The switch box 568 further has a PLC communication section 574 for transmitting to the group of LED illuminating lamps, via the cable 54 according to operation on the operation section 570, a signal for switching between light adjustment control (hereinafter referred to as the "daytime illumination mode") with consideration given to outside light during the day as described above and simple uniform-intensity lighting (hereinafter referred to as the "normal mode").

Example 5 is suitable for information exchange between luminance sensors at the left and right ends of a row of directly connected LED illuminating lamps and for automatic light adjustment control based on it, and is configured to rely on PLC communication. Information exchange, however, is not limited to that relying on PLC communication, but may be conducted via a dedicated communication line among LED illuminating lamps. Automatic light adjustment control using illuminance sensors as in Example 5 is not limited to that relying on information exchange among LED illuminating lamps, nor to that achieved through autonomous control by LED illuminating lamps themselves. For example as in Example 1 shown in FIG. 3, information exchange between illuminance sensors may be performed by a wireless communication section, and in addition information exchange may be conducted via a remote control unit control section 72 in a remote control section 68 so that comparison of illuminance sensor information and control of lighting duties may be performed comprehensively by the remote control unit control section 72.

Figure 16:
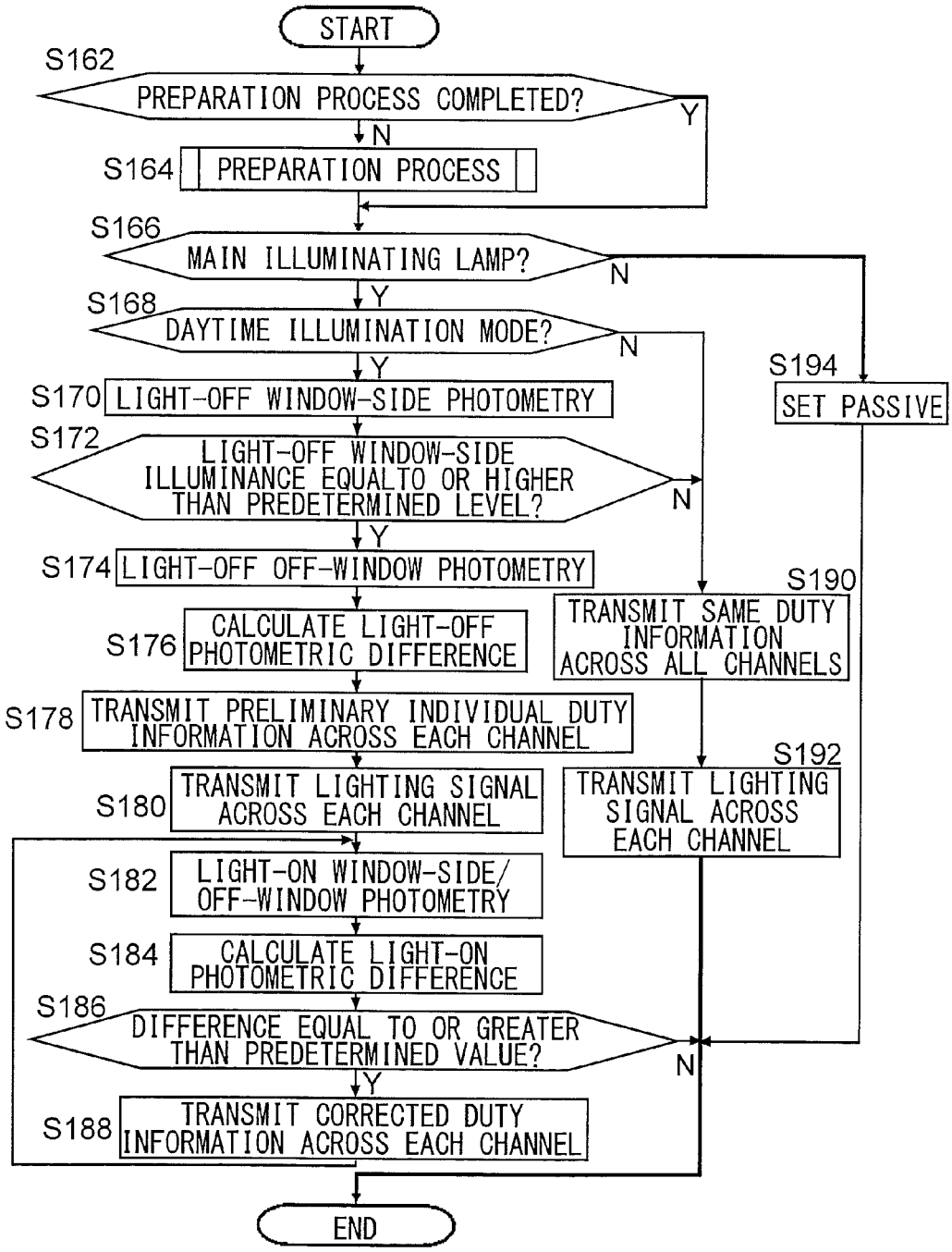
FIG. 16 is a flow chart showing the function of an illumination control section in Example 5.

FIG. 16 is a flow chart showing the function of the illumination control section 562 etc. in the LED illuminating lamp 516 in Example 5 shown in FIG. 15. The flow starts when the switch 575 is so operated as to start to energize the LED illuminating lamp 516. This flow applies to the configuration exactly as shown in FIG. 15 where information exchange between illuminance sensors is performed directly between LED illuminating lamps and comparison of illuminance sensor information and control of lighting duties are autonomously performed by LED illuminating lamps themselves.

When the flow starts, first, at step S162, whether or not a preparation process has been completed is checked. If it is not completed yet, the flow proceeds, through the preparation process at step S164, to step S166. On the other hand, if the preparation process has been completed, the flow proceeds directly to step S166. In the preparation process at step S164, which LED illuminating lamp to select as the main LED illuminating lamp of which the control section will perform comprehensive control is determined, and for the measurement of lightness in the room by illuminance sensors, the part of the lightness ascribable to the light emitted by the LED illuminating lamps themselves is compensated for to make it possible to measure the part of the lightness ascribable to other than the LED illuminating lamps. The details will be given later.

At step S166, whether or not the LED illuminating lamp currently of interest is the main LED illuminating lamp is checked. If it is the main illuminating lamp, the flow proceeds to step S168, where whether or not the LED illuminating lamp is set for the daytime illumination mode according to operation on the switch box is checked. If it is set for the daytime illumination mode, then, at step S170, the window-side illuminance sensor is made to perform photometry. At this time, no LED illuminating lamps are lit, and thus photometry is performed with lighting off. Then, at step S172, whether or not the window-side lightness with lighting off is equal to or higher than a predetermined level is checked. If the window-side lightness with lighting off is equal to or higher than the predetermined level, this means that there is no significant difference in illuminance between window-side and off-window areas in the room during the day. Thus, the flow proceeds to step S174, where the off-window illuminance sensor is made to perform photometry with lighting off.

After photometry is performed in window-side and off-window areas with lighting off as described above, at step S176, based on the photometric values, the photometric difference with lighting off is calculated. Then, at step S178, based on the calculated photometric difference with lighting off, individual duty information for each channel is tentatively determined and transmitted. Thereafter, at step S180, a lighting signal is transmitted across each channel. As a result, based on the tentative duty information across each channel, the individual LED illuminating lamps are lit in a state as shown in FIG. 2(C2).

Then, at step S182, the window-side and off-window illuminance sensors are made to perform photometry with lighting on, and then, at step S184, based on the photometric values, the photometry difference with lighting on is calculated. Then, at step S186, whether or not the difference is equal to or greater than a predetermined value is checked and, if the difference is equal to or greater than the predetermined value, then, at step S188, corrected duty information for cancelling the difference is transmitted across each channel, and the flow returns to step S182. Thereafter, so long as a difference equal to or greater than the predetermined value is detected at step S186, steps S182 through S188 are repeated to correct the duties. When, at step S186, the difference is equal to or less than the predetermined value, the flow ends. In this way, at step S170 and from step S174 through S178, duties are determined by calculation before lighting; then, from step S182 through S188, actual lightness with lighting on is measured, and the duties are corrected.

If, at step S168, the daytime illumination mode is not found to be set, or if, despite the daytime illumination mode being set, at step S172, the window-side lightness with lighting off is equal to or lower than the predetermined level (that is, if there is no difference in lightness between window-side and off-window areas with lighting on as at night), the flow proceeds to step S190, where the same duty information is transmitted across all channels and then, at step S192, a lighting signal is transmitted across each channel, and then the flow ends. If, at step S166, the LED illuminating lamp currently of interest is not found to be the main LED illuminating lamp, the flow proceeds to step S194, where it is set to be passive to wait an instruction from another LED illuminating lamp, and then the flow ends.

In Example 4, even after a uniformly lit state is achieved in the room in the daytime illumination mode, an interruption signal is generated every predetermined period of time, and in response to the interruption signal, the steps S182 through S188 are repeated. In this way, it is possible to vary the duties in constant accordance with variation in outside lightness due to passage of time and change of weather and thereby keep illuminance in the room uniform.

Figure 17:
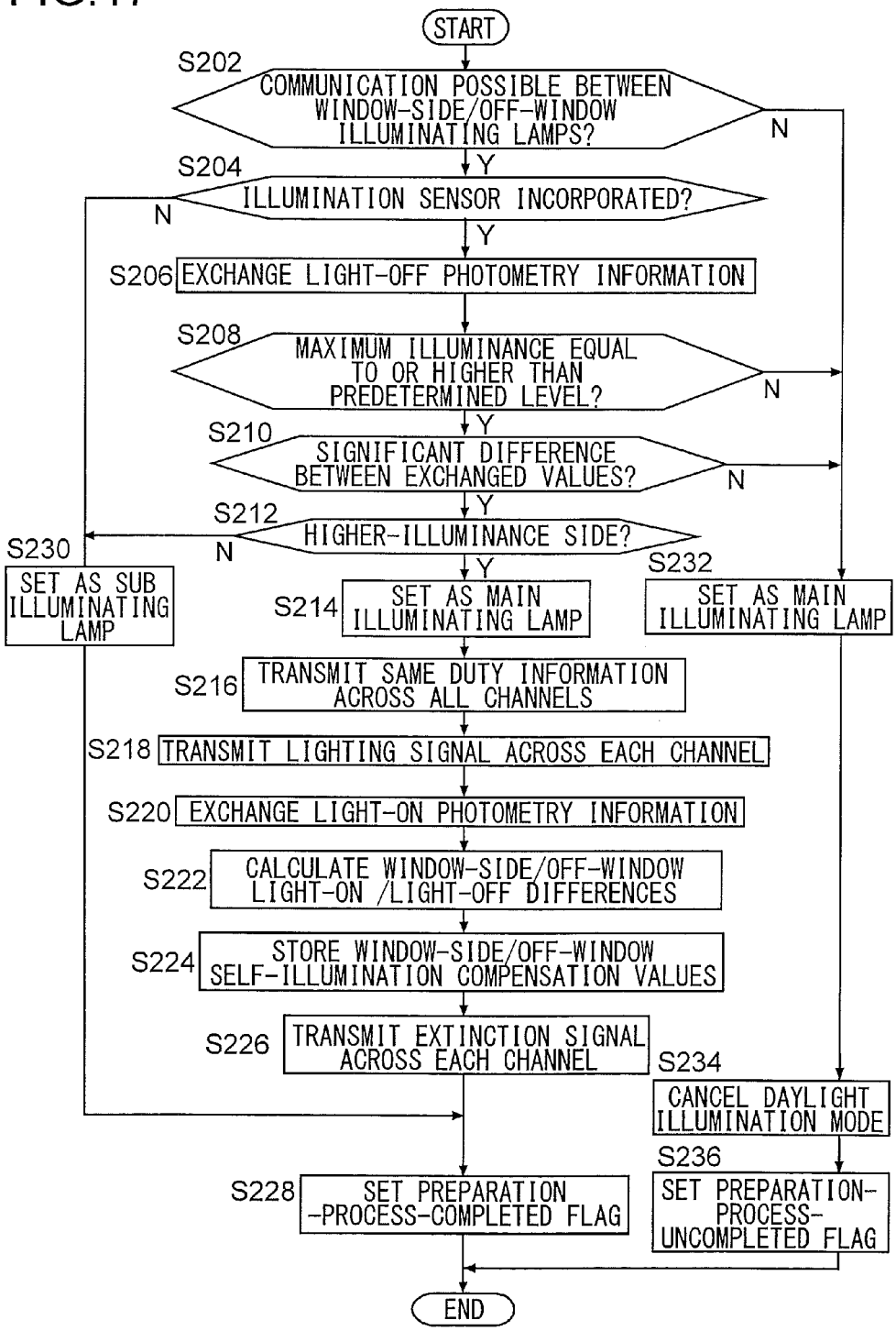
FIG. 17 is a flow chart showing the details of step S164 in FIG. 16.

FIG. 17 is a flow chart showing the details of the preparation process at step S164 in FIG. 16. When the flow starts, at step S202, it is checked whether or not communication is possible between the LED illuminating lamps at the window-side and off-window ends of the same row of LED illuminating lamps. If it is possible, then, at step S204, whether or not the LED illuminating lamp currently of interest is one incorporating an illuminance sensor is checked. If it is an LED illuminating lamp incorporating an illuminance sensor, then, at step S206, photometry information at the time of extinction is exchanged, and then, at step S208, whether or not the maximum illuminance is equal to or higher than a predetermined level is checked. The aim is to permit the preparation process to be performed during the day under sufficient outside light.

If, at step S208, the maximum illuminance is found to be equal to or higher than the predetermined level, the flow proceeds to step S210, where whether or not there is a significant difference in the exchanged photometric values of illuminance sensors. The aim is to confirm whether there is so great a difference in illuminance between window-side and off-window areas as to justify control in the daytime illumination mode. If there is a significant difference, then the flow proceeds to step S212, where the LED illuminating lamp currently of interest is the one incorporating the illuminance sensor at the maximum luminance side (that is, the window-side illuminance sensor) is checked. If so, then, at step S214, the LED illuminating lamp currently of interest is set as the main LED illuminating lamp.

Next, through the steps starting at step S216, the functions of the main LED illuminating lamp are performed. First, at step S216, the same duty information is transmitted across all channels, and at step S218, a lighting signal is transmitted across each channel. Then, at step S220, photometry information with lighting on is exchanged. Based on the information obtained up to now, at step S222, for each of the window-side and off-window illuminance sensors, the difference between with lighting on and with lighting off is calculated. Thus, these differences indicate the influence of the light emitted by the LED illuminating lamps themselves on the outputs of the illuminance sensors. Accordingly, at step S224, the influence of the light emission by the LED illuminating lamps themselves on each of the window-side and off-window illuminance sensors is stored. The stored values are used as correction values in the calculation of the photometric difference with lighting on at step S184 in FIG. 16. Now that correction values have been determined, at step S226, an extinction signal is transmitted across each channel and, at step S228, the flag indicating the completion of the preparation process is set, and the flow ends.

On the other hand, if, at step S204, the LED illuminating lamp currently of interest is not one incorporating an illuminance sensor, or if, at step S212, the LED illuminating lamp currently of interest is not one incorporating the window-side illuminance sensor, then the flow proceeds to step S230, where the LED illuminating lamp currently of interest is set as a sub LED illuminating lamp, and the flow proceeds to step S228. If, at step S202, communication is not found to be possible between the LED illuminating lamps at the window-side and off-window ends of the same row of LED illuminating lamps, this means that no exchange of photometry information is possible between illuminance sensors; thus, the flow proceeds to step S232, where the LED illuminating lamp currently of interest is set as the main LED illuminating lamp, and then, at step S234, the daytime illumination mode is canceled; then, at step S236, the flag indicating that the preparation process has not been completed is set, and the flow ends. In this way, even when the preparation process ends without being completed, in FIG. 16, the flow proceeds from step S166 to step S190 to enter a lit state.

In the check at step S204 or S212, which LED illuminating lamp to take as the main one is a matter of a rule. That is, the LED illuminating lamp incorporating the window-side illuminance sensor does not necessarily have to be selected as the main LED illuminating lamp as described above; the design in FIG. 17 may be changed such that an LED illuminating lamp incorporating no illuminance sensor, or the LED illuminating lamp incorporating the off-window illuminance sensor, is selected as the main LED illuminating lamp. What matters here is not which LED illuminating lamp to select as the main one, but to make a selection such that any one LED illuminating lamp functions as the main LED illuminating lamp without fail.

The above description of Example 5 deals with a case where, as in Example 1, a common channel is assigned to a group of LED illuminating lamps arranged in the vertical direction and their lighting states are as shown in FIG. 2. This, however, is not meant to limit the application of automatic light adjustment using illuminance sensors to that in Example 5. For example, similar automatic light adjustment is possible also in a case where, as in Example 4 shown in FIG. 14, channel assignment is done such that the row of LED illuminating lamps 2, 4, and 6 is assigned channel 1, the row of LED illuminating lamps 12, 14, and 16 is assigned channel 2, and the row of LED illuminating lamps 22, 24, and 26 is assigned channel 3. In that case, by providing the window-side illuminance sensor, for example, at the LED illuminating lamp 24 and the off-window illuminance sensor, for example, at the LED illuminating lamp 4, it is possible to achieve light adjustment as shown in FIG. 14(C) according to the photometric difference between the window-side and off-window illuminance sensors.

Example 6

Figure 18:
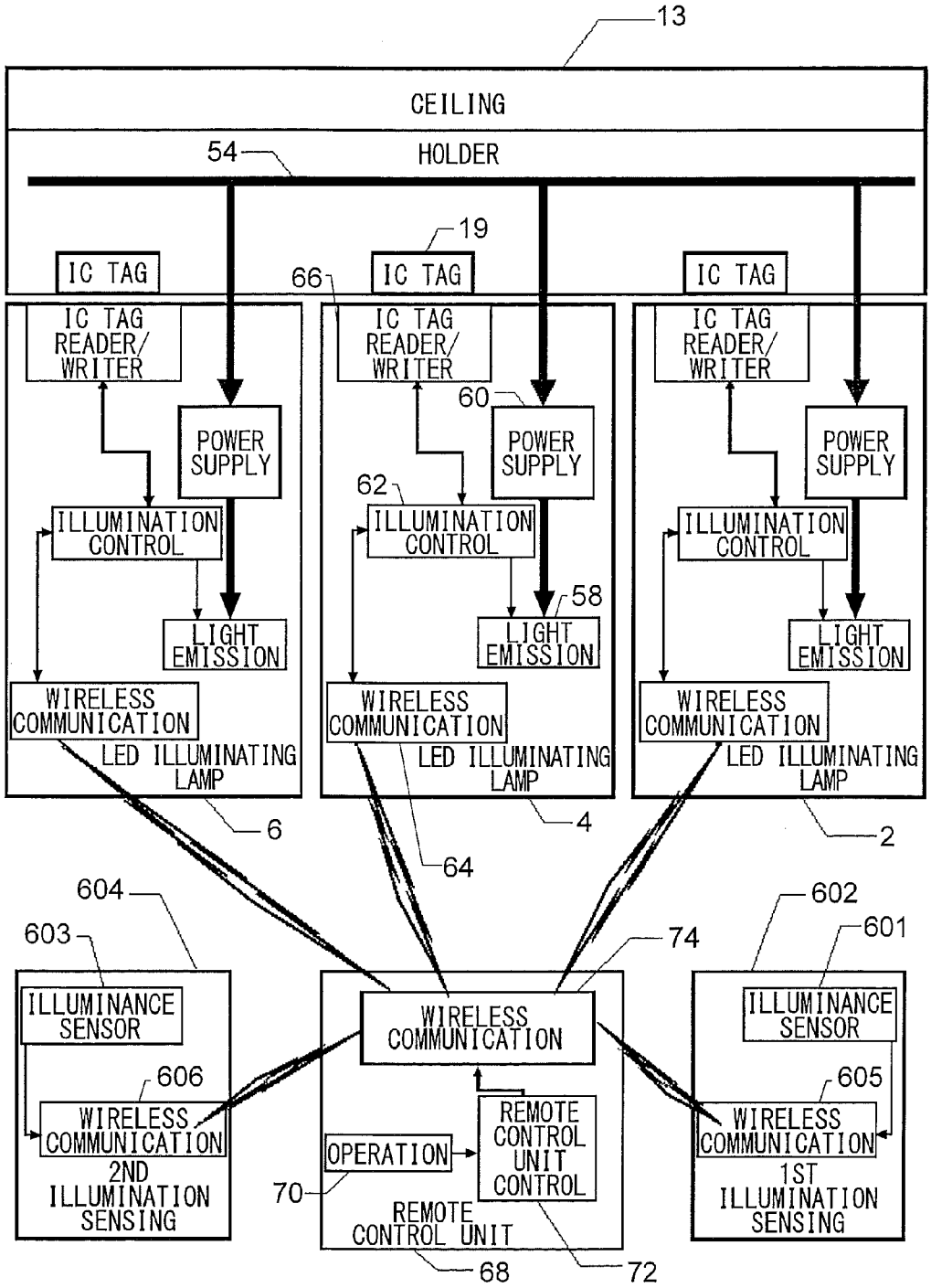
FIG. 18 is a block diagram schematically showing a principal portion of Example 6 of the invention (Example 6)

FIG. 18 is a block diagram schematically showing a principal portion of an illuminating device of Example 6 of the invention. Such parts as are common with Example 1 in FIG. 3 are identified by the same reference signs, and no overlapping description will be repeated. Example 6 too aims to achieve a lighting state as shown in FIG. 2(C2) or 14(C) with consideration given to the influence of outside light in window-side and off-window areas. As will be clear from FIG. 18, the configuration of the LED illuminating lamps 2, 4, and 6 and the remote control unit 68 are common with Example 1 in FIG. 3. Example 6 in FIG. 18 is characterized by the provision of a first illuminance sensing section 602 having an illuminance sensor 601 in a window-side area in a room and a second illuminance sensing section 604 having an illuminance sensor 603 in an off-window area in the room. The first and second illuminance sensing sections 602 and 604 communicate, via wireless communication sections 605 and 606 respectively, with the wireless communication section 74 in the remote control unit 68, and report the results of illuminance measurement.

In Example 5 shown in FIG. 15, the illuminance sensors are provided on the light-source side, that is, in the LED illuminating lamps. This helps concentrate the configuration on the LED illuminating lamp side; however, measured here is not the illuminance on what is actually illuminated, and accordingly the duties for LED illuminating lamps are determined by estimation based on indirect photometry information. By contrast, in Example 6 in FIG. 18, illuminance sensors 601 and 603 are arranged directly on what is actually illuminated, such as on the top of desks. Thus, measured here is the difference in illuminance between on a window-side desk and on a off-window desk, and this makes it possible to perform light adjustment of LED illuminating lamps such that the sum of outside light and the light of LED illuminating lamps are equal at those two places as measured on the desks.

In Example 6 shown in FIG. 18, the calculation of the photometric difference and the control of the duty across each channel are preformed by the remote control unit control section 72. The flow for the control is achieved by repeating steps S182 through S188 in FIG. 16. Since the control here is based on values actually measured on what is actually illuminated, there is no need to calculate a correction value as in steps S222 and S224 in FIG. 17.

The above description of Examples 5 and 6 deals with, for simplicity's sake, a case where the room has a window only at one side and no window at the opposite, off-window side. This is not meant to limit the application of the above-described features of the present invention. For example, application is also possible in a case where the room has windows at both sides and thus, during the day, with lighting off, the room is light at both sides near the windows and dim at the center. In that case, assuming that the row of LED illuminating lamps runs perpendicularly to the windows, light adjustment control is performed to achieve a lighting state as shown in FIG. 1(C3). Such light adjustment control can be achieved by using, for one half of the room, the control in Example 5 or 6 and adopting, for the other half of the room, control that provides a lighting state which is the mirror-image reverse of that control. In that case, needless to say, another illuminance sensor is needed in the LED illuminating lamp, or on the desk, at the center of the room.

Example 7

Figure 19:
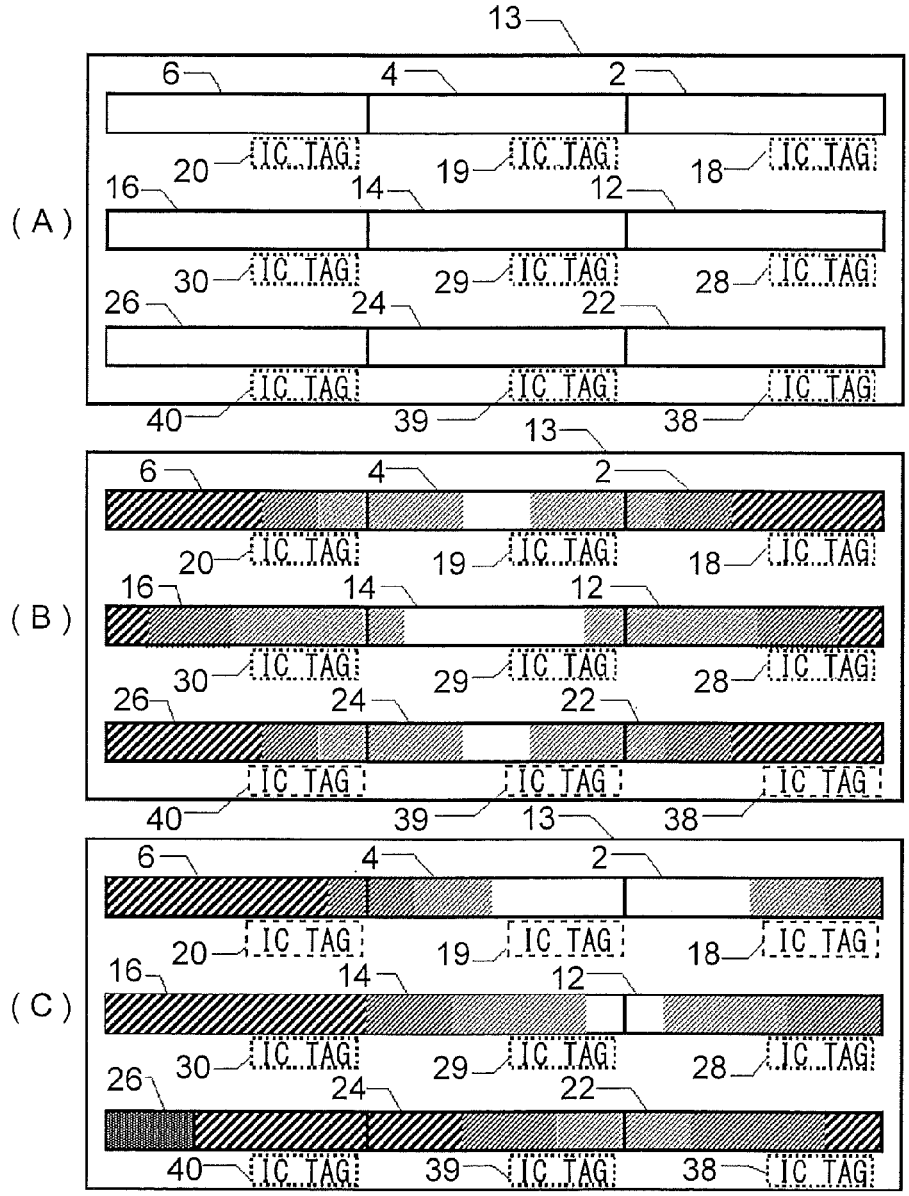
FIG. 19 comprises ceiling arrangement diagrams of an illuminating device in different illumination control section in Example 7 of the invention.

FIG. 19 comprises ceiling arrangement diagrams of an illuminating device of Example 7 of the invention in different lighting states as viewed, as in FIG. 2, from below the ceiling 13. In basic configuration, Example 7 too is similar to Example 1. Here, however, different channels are assigned to individual LED illuminating lamps, and an accordingly configured controlling means is adopted. Prior to a detailed description of the controlling means, first, with reference to FIG. 19, different lighting states and their respective significance will be described. FIG. 19(A), like FIG. 2(A1), shows a state in which all LED illuminating lamps are lit. In this case, across all channels, a signal demanding the lighting of all LED illuminating lamps at a duty of 100% is transmitted.

On the other hand, in FIG. 19(B), a central part of the LED illuminating lamp 14 constituting four-sixths thereof is lit at a duty of 100% and one-sixth at each end is lit at a duty of 50%. In contrast, in each of the LED illuminating lamps 4 and 24 located on opposite sides of the LED illuminating lamp 14, the central part lit at a duty of 100% is narrower than in the LED illuminating lamp 14. For the rest, the lighting state is such that, the farther away from the central portion of the LED illuminating lamp 14, the duty decreases approximately concentrically.

A lighting state like that in FIG. 19(B) is suitable, for example, in a case where, in a large room, a person is present only directly under the LED illuminating lamp 14 and thus the necessity to illuminate around is low. For example, the lighting state in FIG. 19(A) is one adopted when all the people in a large room are at their desks working, and the lighting state in FIG. 19(B) is one adopted when a person directly under the LED illuminating lamp 14 is working overtime after people around have left for home. For similar purposes, LED illuminating lamps in a large room may be fitted with switches individually so that those where no people are present can be switched off. With gradations as shown in FIG. 19(B), it is possible to provide a gentler lighting environment.

FIG. 19(C) shows an example for a case where a person is present at the midpoint between the LED illuminating lamps 2 and 4, and the lighting state is such that, the farther away from that point, the duty decreases approximately concentrically. Although the description of FIG. 19 deals with a case where there is one center point, even when a plurality of center points are spread across the room, the control of Example 7 is possible. In that case, an illumination condition results which is a combination of lighting states in each of which, the farther away from one of those center points, the duty decreases approximately concentrically.

Figure 20:
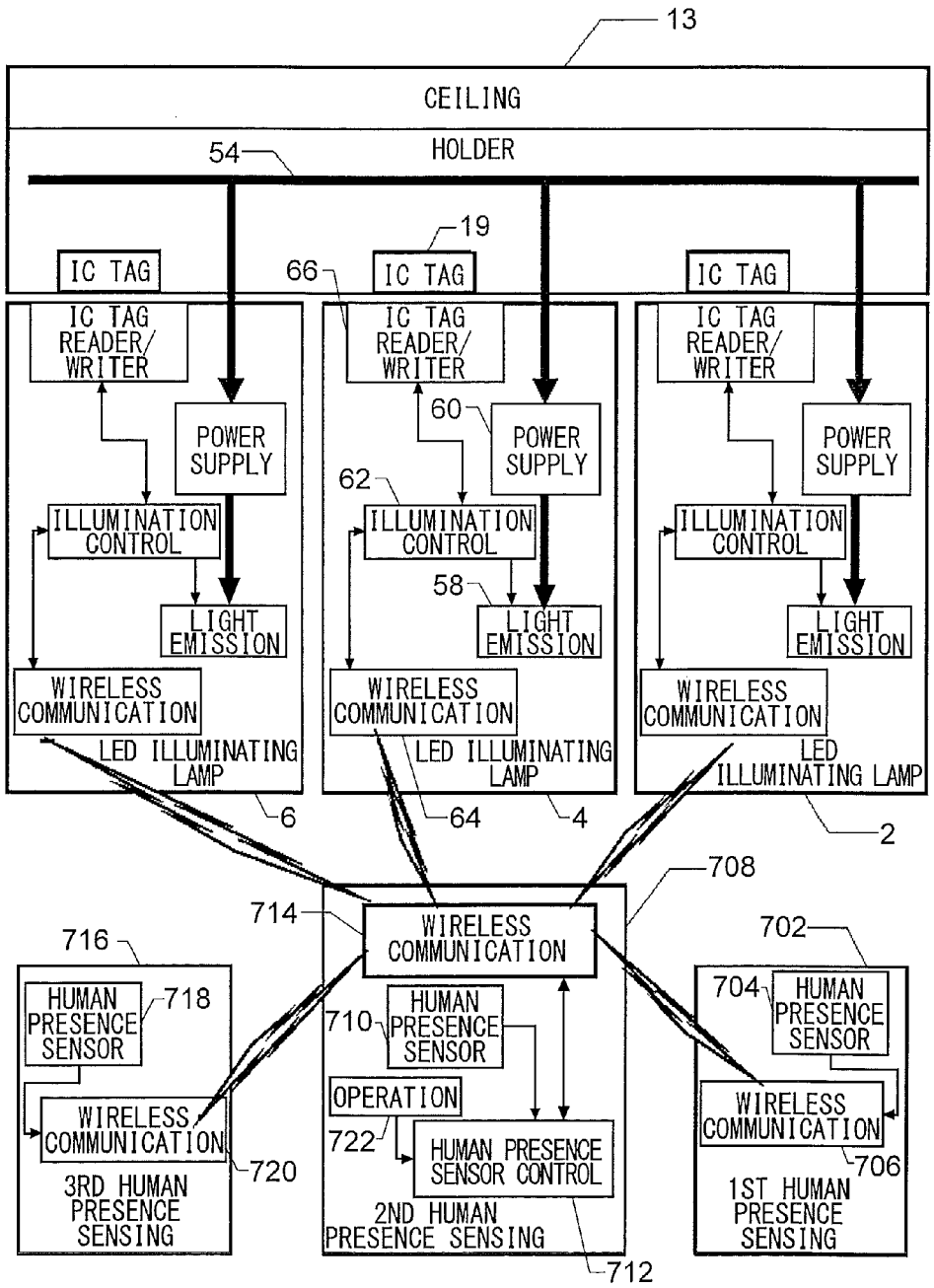
FIG. 20 is a block diagram schematically showing a principal portion of Example 7

FIG. 20 is a block diagram schematically showing a principal portion of Example 7, which achieves the illumination conditions shown in FIG. 19. Such parts as are common with Example 1 in FIG. 3 are identified by the same reference signs, and no overlapping description will be repeated. As will be clear from FIG. 20, the configuration of LED illuminating lamps 2, 4, and 6 is common with Example 1 in FIG. 3. Example 7 in FIG. 20 is characterized in that, to achieve illumination conditions as shown in FIG. 19, human presence sensing sections are provided at appropriate positions in the room. Preferably, for illumination in a large room in which a number of people work at desks, human presence sensing sections are provided one at the desk of each person so that it is possible to grasp whether or not people are at their desks individually and surely. In that case, the relationship between the positions of individual human presence sensing sections and LED illuminating lamps is registered in advance by means of IDs.

Specifically, a first human presence sensing section 702 has a human presence sensor 704 for sensing the presence of a person at a desk in the illumination range of the LED illuminating lamp 2, and transmits the sensing result from a wireless communication section 706. A second human presence sensing section 708 has a human presence sensor 710 for sensing the presence of a person at a desk in the illumination range of the LED illuminating lamp 4, and reports the sensing result to a human presence sensor control section 712. The human presence sensor control section 712 receives the sensing result of the human presence sensor 704 via a wireless communication section 714 from the wireless communication section 706. A third human presence sensing section 716 has a human presence sensor 718 for sensing the presence of a person at a desk in the illumination range of the LED illuminating lamp 6, and reports the sensing result to the human presence sensor control section 712 via a wireless communication section 720 or the wireless communication section 714. Though not illustrated, similar first human presence sensing sections are provided at appropriate positions in the room, and each of them reports the human presence sensing result to the human presence sensor control section 712 by wireless communication. The reporting from each human presence sensing section to the human presence sensor control section 712 may be by wired communication instead of wireless communication.

As described above, the human presence sensor control section 712 receives reports of human presence from different sections, determines an illumination condition which is, like the one shown in FIG. 19(B) or (C), graded lighting increasingly dimmer concentrically away from the center where a person is present or a combination of such lighting states, and transmits lighting signals and duty signals from the wireless communication section 714 to the individual LED illuminating lamps by wireless communication across the relevant channels. The second human presence sensing section 708 is provided with an operation section 722 so as to be capable, like the remote control unit in FIG. 3, of manually transmitting control signals to the individual LED illuminating lamps.

In Example 7 described above, the second human presence sensing section 708 functions both as a human presence sensing section and as a control section. This, however, is not meant to limit the implementation of the present invention. For example, the functions of the second human presence sensing section 708 may be so divided that the second human presence sensing section 708 itself functions only to perform sensing and wireless communication reporting like the other human presence sensing sections, and the control function for achieving control in response to the reports from the individual human presence sensing sections is performed by a dedicated control section as in the remote control unit 68 in FIG. 3. Although in Example 7 described above, human presence sensing sections are arranged on desks or the like that are placed near people, they may instead be provided on the LED illuminating lamp side to check whether or not a person is present directly under LED illuminating lamps.

Although, for easy understanding, the examples presented above have each been described to have different features, this is not meant to hamper one embodiment to have features from different embodiments. For example, one embodiment may have both the control relying on illuminance sensors in Example 4 or 5 and the control relying on human presence sensors in Example 6, or an embodiment may have different features as selectable modes.

Hereinafter, various technical ideas disclosed in the present specification will be summarized.

According to one technical idea disclosed in the present specification, an illuminating device is provided which is provided with: a first illuminating lamp which is arranged at a first predetermined position and which is identifiable; a second illuminating lamp which is arranged at a second predetermined position having a predetermined relationship with the first predetermined position and which is identifiable; determining means for determining an interrelationship between the first and second illuminating lamps; and transmitting means for transmitting identifiable control signals to the first and second illuminating lamps respectively to enable determination by the determining means. This makes it possible to control a plurality of illuminating lamps in a mutually associated manner.

According to a specific feature disclosed in the present specification, the first and second illuminating lamps each include a plurality of LEDs. Providing a plurality of light sources in each illuminating lamp in this way makes it possible to make the interrelationship between the first and second illuminating lamps flexible.

According to another specific feature disclosed in the present specification, the first and second illuminating lamps are arranged so as to appear to emit light with no seam between them. This makes it possible to achieve seamless linear illumination, and to make the first and second illuminating lamps interrelate with each other in such linear illumination.

According to yet another specific feature disclosed in the present specification, the determining means determines the interrelationship so as to change the lighting condition at a midway point within at least one of the first and second illuminating lamps and apply a common lighting condition in the parts of the first and second illuminating lamps where they are connected together. This makes it possible to set borderlines flexibly in dividing linear illumination into lit and extinguished parts and in applying gradations. According to still another specific feature disclosed in the present specification, it is possible to change the part at which the lighting condition is changed.

According to another feature disclosed in the present specification, an illuminating device is provided which is provided with: information storing means provided at a predetermined position where an illuminating lamp is arranged; and an illuminating lamp which, when arranged at that predetermined position, acquires stored information from the information storing means. This permits, on an occasion of replacement of an illuminating lamp, the newly arranged illuminating lamp to acquire the necessary information from the information storing means at the predetermined position.

According to a specific feature disclosed in the present specification, the stored information is information necessary to control the illuminating lamp. It is useful, for example in a case where a plurality of illuminating lamps are controlled in an associated manner as described above, as information for identifying the individual illuminating lamps. According to another specific feature disclosed in the present specification, the stored information is stored from the illuminating lamp to the information storing means, and when the illuminating lamp is replaced, the new illuminating lamp acquires the stored information from the information storing means. With this configuration, there is no need to store information in the information storing means in advance, and instead information can be stored via the illuminating lamp arranged; when the illuminating lamp is replaced later, the information will be inherited.

As described above, according to a technical idea disclosed in the present specification, it is possible to control a plurality of illuminating lamps in a mutually associated manner, and in addition it is possible to acquire information needed for illuminating lamps effectively.

According to one technical idea disclosed in the present specification, an illuminating lamp is provided which is provided with: a first LED group; a second LED group which is arranged in a different region from the first LED group; a first control section which controls the lighting of the first LED group; a second control section which controls the lighting of the second LED group; and a signal input section which inputs, from outside to the first and second control sections, a control signal for controlling the first and second LED groups independently. This makes it possible to split a singe illuminating lamp into a plurality of parts and control them independently. This feature is particularly suitable in a case where the first LED group has a plurality of LEDs arranged in a row and the second LED group has a plurality of LEDs arranged in a row which is on an extension line of the row of the first LED group. It is then possible to change the lighting condition at a midway point within an illuminating lamp having an LED group arranged in a row.

According to a specific feature disclosed in the present specification, the illuminating lamp is provided with: a first power supply section which energizes the first LED group and the first control section; and a second power supply section which energizes the second LED group and the second control section. With this feature, it is possible to perform control independently for each power supply section, which is realistic. According to another specific feature, the illuminating lamp is provided with: a first circuit board on which the first LED group and the first control section are mounted; and a second circuit board on which the second LED group and the second control section are mounted. With this feature, it is possible to perform control independently for each circuit board, which is suitable. According to yet another specific feature, the first LED group has a plurality of LEDs that are serially connected and the second LED group has a plurality of LEDs that are serially connected separately from the first LED group. With this feature, it is possible to perform control finely for each ultimate unit of serially connected LEDs.

According to another feature disclosed in the present specification, an illuminating lamp is provided which is provided with: a first light emission section forming a row; a second light emission section forming a row and arranged on an extension line of the row of the first light emission section; a first control section which controls the lighting of the first light emission section; a second control section which controls the lighting of the second light emission section; and a signal input section which inputs, from outside to the first and second control sections, a control signal for controlling the first and second LED groups independently. Thus, according to the second technical idea described above, it is possible to control an illuminating lamp, in particular one having a light emission section forming a row, with the lighting condition changed at a midway point; thus, it is possible to light an illuminating lamp in a variety of lighting conditions and thereby achieve illumination best fit for a given situation.

According to another feature disclosed in the present specification, an illuminating device is provided which is provided with: a first illuminating lamp having a first light emission section forming a row and a second light emission section forming a row and arranged on an extension line of the row of the first light emission section; a second illuminating lamp having a third light emission section forming a row and arranged on an extension line of the row of the second light emission section and a fourth light emission section forming a row and arranged on an extension line of the row of the third light emission section; and a control section which can control such that the first and second light emission sections are lit in different lighting conditions and the second and third light emission sections are lit in the same lighting condition. With this feature, it is possible to achieve a lighting condition in which the lighting condition changes at a midway point within the first illuminating lamp and there is no seam between the first and second illuminating lamps as if they were a seamless, continuous, single illuminating lamp. Thus, it is possible to light an illuminating lamp in a variety of lighting conditions and thereby achieve illumination best fit for a given situation.

According to another feature disclosed in the present specification, an illuminating device is provided which is provided with: a plurality of light emission sections; a control section which controls the plurality of light emission sections independently; a plurality of photometry sections which are arranged at different positions; and a commanding section which issues a command for control to be executed by the control section based on the result of photometry by the plurality of photometry sections. With this feature, it is possible to light an illuminating lamp in a variety of conditions according to photometry on the illumination target and thereby realize illumination best fit for a given situation. For example, during the day, while illumination is reduced near a window where outside light shines in, illumination is increased inward of the room; it is thus possible to achieve uniform illumination throughout the room. In a case where a plurality of photometry sections are arranged each near the corresponding one of a plurality of light emission sections, the configuration is simple, but correcting means needs to be provided to compensate for the influence of the light emitted from the light emission sections themselves on the photometry sections. In a case where a plurality of photometry sections are located at positions illuminated by a plurality of light emission sections respectively, it is possible to directly measure the influence of both outside light and the illumination by the light emission sections.

According to another feature disclosed in the present specification, an illuminating device is provided which is provided with: a plurality of light emission sections; a control section which controls the plurality of light emission sections independently; means for determining a target position; and a commanding section which issues a command for control to be executed by the control section to achieve an illumination condition with the determined target position at the center. This makes it possible to light an illuminating lamp in a variety of lighting conditions and thereby achieve illumination best fit for a given situation. According to a specific feature disclosed in the present specification, the commanding section instructs the control section to reduce the amount of light emitted by those light emission sections which are responsible for, with respect to the target position, an area far from the target position. This makes it possible to achieve illumination that suits a given need of illumination even in a large room or the like. According to a specific feature disclosed in the present specification, the means for determining a target position is means for sensing human presence, and this makes it possible to achieve illumination in a room with focus on where a person is present.

As discussed above, according to the technical ideas disclosed in the present specification, it is possible to light an illuminating lamp in a variety of lighting conditions, and thus to achieve illumination best fit for a given situation.

INDUSTRIAL APPLICABILITY

The present invention provides an illuminating device suitable for ceiling illumination and wall surface illumination. The present invention also provides an illuminating lamp and an illuminating device suitable for illumination, such as ceiling illumination, using a plurality of illuminating lamps.

LIST OF REFERENCE SIGNS

4, 14, 24 first illuminating lamp
6, 16, 26 second illuminating lamp

70 determining means
74 transmitting means
56 LED
8 control section
16 indication section
19, 20 identification information storing means
19, 20 information storing means
82, 302, 402-406 first LED group
84, 304, 412-416 second LED group
98, 122, 310, 326, 408, 422 first control section
100, 124, 312, 328, 418, 424 second control section
64, 564 signal input section
94 first power supply section
96 second power supply section
138 first circuit board
140 second circuit board
302, 304 group of serially connected LEDs
82, 302, 402-406 first light emission section forming a row
84, 304, 412-416 second light emission section forming a row
68, 562, 708 commanding section
501, 503, 601, and 603 photometry section
704, 710, 718 target position determining means
82, 84, 302, 304, 402-406, 412-416 a plurality of light emission sections
98, 122, 310, 326, 408, 422 first control section
100, 124, 312, 328, 418, 424 second control section
562 correcting means
704, 710, 718 means for sensing human presence

The invention claimed is:

1. An illuminating device comprising:
a holder having a first predetermined position and a second predetermined position having a predetermined relationship with the first predetermined position;
a first illuminating lamp which is fitted to the first predetermined position and which is identifiable;
a second illuminating lamp which is fitted to the second predetermined position and which is identifiable;
a controller configured to control the first and second illuminating lamps cooperatively in accordance with identification information for identifying the first and second illuminating lamp, respectively; and
a transmitter configured to transmit the identification information from the holder to the first and second illuminating lamps respectively to enable the cooperative control of the first and second illuminating lamps by the controller.

2. The illuminating device according to claim 1, wherein the first and second illuminating lamps each include a plurality of LEDs.

3. The illuminating device according to claim 1, wherein the first and second illuminating lamps are fitted to the first and second predetermined positions so as to appear to emit light with no seam therebetween.

4. The illuminating device according to claim 3, wherein the controller is configured to control the first and second illumination lamps such that lighting condition changes at a midway point within at least one of the first and second illuminating lamps and that a common lighting condition is applied in portions of the first and second illuminating lamps which joint the first and second illuminating lamps.

5. The illuminating device according to claim 4, wherein the determining means can alter the point at which lighting condition changes.

6. The illuminating device according to claim 1, wherein
information storage is provided at each of the first and second predetermined positions, and
when the first and second illuminating lamps are fitted to the first and second predetermined positions, the transmitter transmits the identification information from the information storage to the first and second illuminating lamps, respectively.

7. An illuminating device comprising:
a holder;
information storage provided at the holder to keep information;
an illuminating lamp which is fitted to the holder; and
a transmitter configured to transmit the information from the information storage to the illuminating lamp, when the illuminating lamp is fitted to the holder.

8. The illuminating device according to claim 7, wherein the information is identification information necessary to control the illuminating lamp.

9. The illuminating device according to claim 7, wherein the information in the information storage originates from an illuminating lamp formerly fitted to the predetermined position and having been removed therefrom, and
when the illuminating lamp is newly fitted to the predetermined position for replacement, the transmitter transmits the information from the information storage to the illumination lamp.

10. An illuminating lamp used in the illuminating device according to claim 7, wherein the illuminating lamp comprises:
a first LED group;
a second LED group which is arranged in a different region from the first LED group;
a first control section which controls lighting of the first LED group;
a second control section which controls lighting of the second LED group; and
a signal input section which inputs, from outside to the first and second control section, a signal for controlling the first and second LED groups independently.

11. The illuminating lamp according to claim 10, wherein
the first LED group has a plurality of LEDs arranged in a row, and
the second LED group has a plurality of LEDs arranged in a row on an extension line of the row of the first LED group.

12. The illuminating lamp according to claim 10, further comprising:
a first power supply section which energizes the first LED group and the first control section; and
a second power supply section which energizes the second LED group and the second control section.

13. The illuminating lamp according to claim 10, further comprising:
a first circuit board on which the first LED group and the first control section are mounted; and
a second circuit board on which the second LED group and the second control section are mounted.

14. The illuminating lamp according to claim 10, wherein
the first LED group has a plurality of LEDs that are serially connected, and
the second LED group has a plurality of LEDs that are serially connected separately from the first LED group.

15. An illuminating device comprising:
a holder having a first predetermined position and a second predetermined position having a predetermined relationship with the first predetermined position;
a first illuminating lamp having a first light emission section forming a row and a second light emission section forming a row and arranged on an extension line of the row of the first light emission section, the first illuminating lamp being fitted to the first predetermined position and removable as a unit therefrom;

a second illuminating lamp having a third light emission section forming a row and arranged on an extension line of the row of the second light emission section and a fourth light emission section forming a row and arranged on an extension line of the row of the third light emission section, the second illuminating lamp being fitted to the second predetermined position and removable as a unit therefrom; and a commanding section which performs control such that the first and second light emission sections are lit in different lighting conditions and the second and third light emission sections are lit in a same lighting condition.

16. The illuminating device according to claim 15, further comprising:

a plurality of photometry sections which are arranged at different positions; and an instruction section which instructs the commanding section to perform control based on a result of photometry by the plurality of photometry sections.

17. The illuminating device according to claim 16, wherein the plurality of photometry sections are arranged close to the plurality of light emission sections respectively, and have correcting means for compensating for an influence of light emitted by the light emission sections themselves on the photometry sections.

18. The illuminating device according to claim 16, wherein the plurality of photometry sections are arranged at positions illuminated by the plurality of light emission sections respectively.

19. The illuminating device according to claim 15, further comprising:

a determination section configured to determine a target position; and an instruction section which instructs the commanding section to perform control such as to apply an illumination condition with the target position set at a center.

20. The illuminating device according to claim 19, wherein the instruction section instructs the commanding section to reduce an amount of light emitted by any of the light emission sections which is responsible for illumination of an area far from the target position set at the center.

* * * * *